US012693064B2

(12) United States Patent
Niknammoghadam et al.

(10) Patent No.: US 12,693,064 B2
(45) Date of Patent: Jul. 28, 2026

(54) MODULAR CRYOGENIC COOLING SYSTEM

(71) Applicant: BLUEFORS OY, Helsinki (FI)

(72) Inventors: Amir Niknammoghadam, Helsinki (FI); Pieter Vorselman, Helsinki (FI); Matti Manninen, Helsinki (FI); Leif Roschier, Helsinki (FI); David Gunnarsson, Helsinki (FI)

(73) Assignee: BLUEFORS OY, Helsinki (FI)

( * ) Notice: Subject to any disclaimer, the term of this patent is extended or adjusted under 35 U.S.C. 154(b) by 155 days.

(21) Appl. No.: 18/710,976

(22) PCT Filed: Nov. 14, 2022

(86) PCT No.: PCT/FI2022/050745
§ 371 (c)(1),
(2) Date: May 16, 2024

(87) PCT Pub. No.: WO2023/089233
PCT Pub. Date: May 25, 2023

(65) Prior Publication Data

US 2025/0052479 A1 Feb. 13, 2025

(30) Foreign Application Priority Data

Nov. 18, 2021 (EP) ..... 21209097

(51) Int. Cl.
*F25D 19/00* (2006.01)
*F25B 9/12* (2006.01)

(52) U.S. Cl.
CPC ..... *F25D 19/006* (2013.01); *F25B 9/12* (2013.01)

(58) Field of Classification Search
CPC .... F25B 9/12; F25B 9/14; F25B 9/145; F25B 2400/21; F25B 9/10; B01L 2300/1894;
(Continued)

(56) References Cited

U.S. PATENT DOCUMENTS 8,818,471 B2 * 8/2014 Kawashima ..... H01F 27/303 505/211
11,125,475 B2 * 9/2021 Matthews ..... F25B 9/12
(Continued)

FOREIGN PATENT DOCUMENTS

CN 113631878 A 11/2021
GB 2584135 A † 11/2020
(Continued)

OTHER PUBLICATIONS

JP-2002209869-A English Translation (Year: 2002).*
(Continued)

*Primary Examiner* — Frantz F Jules
*Assistant Examiner* — Devon Moore
(74) *Attorney, Agent, or Firm* — E. Eric Mills; Nicholas P. Stadnyk; Maynard Nexsen PC

(57) ABSTRACT

A cryogenic cooling system comprises a vacuum chamber, a first support system for cold plates in said vacuum chamber, and a second support system for heat radiation shields in said vacuum chamber. Coupled to said first support system and supported thereby are a plurality of mutually parallel cold plates displaced from each other in a first direction. Said first direction is defined as the direction perpendicular to said cold plates. Coupled to said second support system and supported thereby are a plurality of at least partially nested heat radiation shields. Each of said heat radiation shields is configured to shield a respective subspace adjacent to a corresponding one of said cold plates. At least a first cold plate of said cold plates is a modular cold plate comprising two or more sections adjacent to each other on the same level in said first direction, said sections being coupled to said first support system independently of each other.

18 Claims, 9 Drawing Sheets

(58) Field of Classification Search
CPC ..... B01L 1/025; B01L 7/50; B01L 2400/049; F17C 3/08; F17C 3/085; F17C 13/086; F17C 2201/0157; F17C 2270/0509; F25D 2317/043; F25D 19/00; F25D 19/006; G06N 10/40; H05K 7/20372; F28D 2021/0033; F25J 1/0276; G06F 1/20
USPC ..... 62/51.1, 610
See application file for complete search history.

(56) References Cited

U.S. PATENT DOCUMENTS

| | | | | |
|---|---|---|---|---|
| 11,927,621 | B2 * | 3/2024 | Snow | G01R 31/2877 |
| 2008/0135207 | A1 | 6/2008 | Fukuoka et al. | |
| 2020/0363116 | A1 | 11/2020 | Van Bokkelen et al. | |
| 2023/0090979 | A1 * | 3/2023 | Matthews | F25B 9/145 220/560.04 |
| 2024/0159450 | A1 * | 5/2024 | Gaffet | F25D 23/02 |

FOREIGN PATENT DOCUMENTS

| | | | | | |
|---|---|---|---|---|---|
| GB | 2592415 | A | † | 9/2021 | |
| JP | 1026427 | A | † | 1/1998 | |
| JP | H1026427 | A | | 1/1998 | |
| JP | 2002209869 | A | * | 7/2002 | A61B 5/055 |
| TW | M608986 | U | | 3/2021 | |
| WO | 2020182671 | A1 | | 9/2020 | |
| WO | 2021102181 | A2 | | 5/2021 | |

OTHER PUBLICATIONS

Oxford Instruments Nanotechnology Tools Ltd.: "Proteox LX".
Bluefors: "Cryogen-free XLD dilution refrigerator, Bluefors".
Bluefors: "BF-XLD-Series User manual, Jan. 2016".
Bluefors: "Solenoid magnet option".
Oxford Instruments Nanotechnology Tools Ltd.: "Next Generation Thinking Oxford Instruments, YouTube" (Mar. 10, 2021), https://www.youtube.com/watch?v=CWfyMddV3M8.
Bluefors: "Cool technology enables quantum computing, Bluefors, Youtube" (Jun. 5, 2020), https://www.youtube.com/watch?v=6Dx8TusDMB8.
International Search Report and Written Opinion issued in counterpart PCT Application No. PCT/FI2022/050745 dated Feb. 3, 2023 (nine (9) pages).
P. Magnard et al., "Microwave Quantum Link between Superconducting Circuits Housed in Spatially Separated Cryogenic Systems", 13 pages, Aug. 4, 2020.†
Bluefors, https://web.archive.org/web/20201112005132/https://bluefors.com/products/xld-dilution-refrigerator/, Copyright 2019 Bluefors Oy, Accessed Mar. 11, 2025.†

* cited by examiner
† cited by third party

MODULAR CRYOGENIC COOLING SYSTEM

CROSS REFERENCE TO RELATED APPLICATIONS

This application is a 35 U.S.C. § 371 U.S. national phase entry of International Patent Application No. PCT/FI2022/050745 having an international filing date of Nov. 14, 2022, which claims the benefit of European Application No. 21209097.1 filed Nov. 18, 2021, each of which are incorporated herein by reference in their entireties.

FIELD OF THE INVENTION

The invention is related to the technical field of cryogenic cooling systems. In particular the invention is related to structural and functional solutions that enable easier building, operating, maintenance, and later modification of a large cryogenic cooling system or a cryogenic platform.

BACKGROUND OF THE INVENTION

Cryogenic cooling systems are intricate pieces of machinery designed to cool a target region or payload volume down to very low temperatures and maintain such conditions for desired periods of time. The payload to be cooled may contain e.g. a scientific experiment, a quantum computer, a measurement setup, and/or something else, the correct operation of which requires temperatures in the order of only some kelvins or even well below one kelvin. A cryogenic cooling system may also be called a cryostat. In some sources, the designation cryogenic cooling system is used for just that subsystem of a cryostat that produces the low temperatures, while the cryostat is additionally said to comprise other subsystems like mechanical support, vacuum pumping, radiation shielding, cabling, and the like. In this text the terms cryostat and cryogenic cooling system are used as synonyms of each other, possibly including an interpretation that a cryostat may be somewhat simpler, like a vacuum can with a single cold source (mechanical cooler or bath of liquid cryogen), while a cryogenic cooling system may be more elaborate with an outer cold source for pre-cooling and an inner cold source (such as a dilution refrigerator for example) to reach the coldest temperatures.

FIG. 1 is a simplified schematic illustration of a cryogenic cooling system equipped with a dilution refrigerator and a mechanical pre-cooler. The outermost structure is a vacuum can 101, which is shown with dashed lines in FIG. 1. The topmost flange 102 is the lid of the vacuum can. The room temperature stage 103 of the mechanical pre-cooler is attached thereto. The first stage 104 of the mechanical pre-cooler is attached to a first flange 105 and the second stage 106 of the mechanical pre-cooler is attached to a second flange 107. The first and second flanges may be called the 50 K flange and the 4 K flange for example, reflecting their temperatures during operation.

Further below there are more flanges, like the still flange 108 to which the still 109 of the dilution refrigerator is attached. In FIG. 1 the mixing chamber 110 of the dilution refrigerator is attached to the base temperature flange 111. Reference designator 112 illustrates the payload that is to be refrigerated, frequently referred to as the sample. It is firmly attached to the base temperature flange 111 in order to ensure as good thermal conductance as possible. As the base temperature flange 111 is made of a material that conducts heat as well as possible at cryogenic temperatures, the sample (or other forms of payload) may be attached to any part of it. There may be extending structures called cold fingers thermally coupled to the mixing chamber 110, with which more suitable attachment places for payloads may be provided.

Cylindrical, flat-bottomed radiation shields, which are not shown in FIG. 1 for graphical clarity, are typically attached to the flanges in a nested configuration, in order to keep radiated heat from surrounding, higher-temperature parts from reaching the colder parts inside. The structure may comprise other, intermediate flanges like a so-called 100 mK flange between the still flange 108 and the base temperature flange 111. Aligned apertures 113, 114, and 115 may exist in the flanges to provide, together with a cover 116 at the top, a so-called line-of-sight port to the sample 112.

FIG. 2 illustrates a cryogenic cooling system that is otherwise the same as in FIG. 1 but comprises the possibility of loading samples with a fast sample exchanging mechanism, often called a sample changer for short. It comprises a load lock 201 that can be attached to a gate valve 202. The system depicted in FIG. 2 is of the top-loading type, so the gate valve 202 is in the lid 102 of the vacuum can 101. The sample holder 203 is at the lower end of an elongate probe 204, which can be moved in its longitudinal direction (vertical direction in FIG. 1) to eventually attach the sample holder 203 in place at the target region 205 on the base temperature flange. Systems of bottom-loading type have the gate valve in the bottom of the vacuum can, so that the sample is loaded in from below. Systems of side-loading type are also known, in which the sample loader connects to a gate valve in a side surface of the vacuum can.

Conventional cryogenic cooling systems of the kind schematically shown in FIGS. 1 and 2 have been roughly of the size of a standalone cupboard, with the diameter of the base temperature flange in the order of some tens of centimetres. In the framework of certain applications, in particular quantum computing, larger and larger payload volumes and payload footprints are required. A straightforward approach for providing larger payload volumes and/or footprints is simply to scale up the dimensions of the conventional structure. An example of a large cryogenic cooling system is presented in M. Hollister, R. Dhuley, G. Tatkowski: "A large millikelvin platform at Fermilab for quantum computing applications", available at https://arxiv.org/abs/2108.10816v1. The payload volume of the cryostat described therein is 2 metres in diameter and 1.5 metres in height.

Another approach of scaling up the payload volume and footprint of a cryostat is known from the internet publication available at https://www.cryoworld.com/projects/project-1/. In said approach, the cylindrical main vacuum chamber is placed horizontally and provided with a liquid-helium-cooled 4 kelvin base plate 4 metres in length and 60 centimetres in width. Rectangular doors in the sides of the vacuum chamber make the inside accessible for servicing.

Despite said known attempts, it is not trivial to provide a cryogenic cooling system with a large payload volume. In particular, it would be desirable to present solutions that enable providing large-scale cryogenic cooling systems in a flexible way that can be adapted to various and changing needs concerning cooling capacity, cooling technology, and base temperature, as well as payload size and shape.

SUMMARY

An objective is to present a cryogenic cooling system that has a large and flexibly adaptable payload volume; allows for large payload footprints at desired temperature stages; has easy access to the payload area and parts that need servicing; is easy to operate and maintain; and is capable of reaching temperatures in the millikelvin range or lower if needed. Another objective is that the cryogenic cooling system can be flexibly adapted to different kinds of needs. Yet another objective is to ensure that the cryogenic cooling system is reliable in operation, yet possible to manufacture, assemble, and operate at a reasonable cost.

These and further advantageous objectives are achieved by making the cryogenic cooling system or platform have at least some of the features recited in the appended claims.

According to an aspect, there is provided a cryogenic cooling system that comprises a vacuum chamber, a first support system for cold plates in said vacuum chamber, and a second support system for heat radiation shields in said vacuum chamber. Coupled to said first support system and supported thereby are a plurality of mutually parallel cold plates displaced from each other in a first direction. Said first direction is defined as the direction perpendicular to said cold plates. Coupled to said second support system and supported thereby are a plurality of at least partially nested heat radiation shields. Each of said heat radiation shields is configured to shield a respective sub-space adjacent to a corresponding one of said cold plates. At least a first cold plate of said cold plates is a modular cold plate comprising two or more sections adjacent to each other on the same level in said first direction, said sections being coupled to said first support system independently of each other.

According to an embodiment, said plurality of cold plates comprises an ordered sequence of cold plates configured to be held at temperatures that form a respective monotonically decreasing series from a highest temperature to a lowest temperature. At least one cold plate higher up in said sequence may then be removable from said first support system without removing any of the cold plates below it in said sequence. This involves the advantage of easy disassembling, assembling, and servicing.

According to an embodiment, mutually adjacent edges of said sections of the modular cold plate do not touch each other. This involves the advantage that one can design the thermal coupling between the cold plate modules according to need.

According to an embodiment, a coupling member couples said mutually adjacent edges of said sections to each other. This involves the advantage that one can design the thermal coupling between the cold plate modules according to need.

According to an embodiment, said coupling member comprises at least one of a stainless steel strip, a thermal coupling block, or a shelf support that is part of said first support system and supports said sections by their adjacent edges. This involves the advantage that structural synergy can be achieved and/or the thermal coupling can be designed reliably and in a well defined manner.

According to an embodiment, that one of said heat radiation shields that shields the subspace adjacent to said modular cold plate is thermally insulated from at least one of said sections. This involves the advantage that their temperatures can be set separately, if desired.

According to an embodiment, the cryogenic cooling system comprises a first dedicated cold source configured to cool at least some of said heat radiation shields without cooling any of said cold plates, and a second dedicated cold source configured to cool at least some of said cold plates without cooling any of said heat radiation shields. This involves the advantage that the cooling powers can be used effectively, and that the temperatures of various parts can be selected according to need. Also, this allows exchanging cold sources and selecting the desired technology for the cold sources.

According to an embodiment, the cryogenic cooling system comprises a first dilution refrigerator and a second dilution refrigerator. Said first dilution refrigerator may be configured to cool a first subsection of a target region located on one of said cold plates, and said second dilution refrigerator may be configured to cool a second subsection, thermally insulated from said first subsection, of said target region. This involves the advantage that the payloads can be cooled effectively to desired temperatures.

According to an embodiment, said first subsection of the target region comprises a thermalization stage of connections between the target region and warmer parts of the cryogenic cooling system, and said second subsection of the target region comprises a payload area. This involves the advantage that the payloads can be cooled effectively to desired temperatures.

According to an embodiment, the vacuum chamber has a top, a bottom, and a plurality of connected side surfaces between said top and bottom, at least one of said side surfaces being a flat surface. This involves the advantage that large access and coupling interface can be built relatively simply to the vacuum chamber.

According to an embodiment, the vacuum chamber has a constant polygonal cross section in a plane perpendicular to said first direction. This involves the advantage that the structural geometry can be utilized in a versatile way in building large systems.

According to an embodiment, at least a subset of said heat radiation shields have a similarly shaped cross section as said vacuum chamber. This involves structural advantages in particular when several modules are combined into larger units. Additionally, this way the available space can be utilised effectively.

According to an embodiment, at least one of said subset of heat radiation shields comprises sheet portions releasably coupled to the second support system and to each other. This involves the advantage that only a desired part of the heat radiation shielding needs to be disassembled to get access to desired internal parts of the system.

According to an embodiment, said vacuum chamber is a first vacuum chamber, constituting a first vacuum module in which said first support system and said second support system are located. Said plurality of cold plates may then be a first plurality of cold plates, located in said first vacuum chamber and supported by said first support system. Said plurality of heat radiation shields may then be a first plurality of heat radiation shields, located in said first vacuum chamber and supported by said second support system. The cryogenic cooling system may then comprise a second vacuum chamber, a third support system for cold plates in said second vacuum chamber, and a fourth support system for heat radiation shields in said second vacuum chamber. The cryogenic cooling system may comprise, coupled to said third support system and supported thereby, a second plurality of mutually parallel cold plates displaced from each other in said first direction. The cryogenic cooling system may comprise, coupled to said fourth support system and supported thereby, a second plurality of at least partially nested heat radiation shields, each of said heat radiation shields being configured to shield a respective sub-space adjacent to a corresponding one of said second plurality of cold plates. The cryogenic cooling system may comprises at least one mutual coupling that is at least one of: an opening connecting said first and second vacuum chambers together into a common vacuum space; a thermally conductive connection between a heat radiation shield of the first plurality and a heat radiation shield of the second plurality; a thermally conductive connection between a cold plate of the first plurality and a cold plate of the second plurality. This involves the advantage that the system can be expanded in a modular fashion.

According to an embodiment, each of the first and second vacuum chambers has a top, a bottom, and a plurality of connected side surfaces between said top and bottom, at least one side surface in each of the first and second vacuum chambers being a flat surface. The first and second vacuum chambers may then be adjacent to each other, with said flat side surfaces against each other, and said mutual coupling may go through an interface of which said flat side surfaces are a part. This involves the advantage that the modularly expanded system may have a relatively simple overall structure, and resources may be shared between different modules.

According to an embodiment, the first and second vacuum chambers have said flat side surfaces directly connected to each other, and openings in said flat side surfaces convey said mutual coupling. This involves the advantage that the modularly expanded system may have a relatively simple overall structure, and resources may be shared between different modules.

According to an embodiment, the first and second vacuum chambers are located with said flat side surfaces facing each other at a distance, and one or more conduits between said flat side surfaces convey said mutual coupling. This involves the advantage that the modules of a larger system can be placed more freely.

According to an embodiment, said first and second vacuum chambers share at least one common external support system, which comprises at least one of: mechanical support, vacuum pumps, circulation system of gases, circulation system of cryogenic liquids, operating power, control electronics, communication connections. This involves the advantage that even a large modular system can be built in a relatively compact way.

BRIEF DESCRIPTION OF THE DRAWINGS

The accompanying drawings, which are included to provide a further understanding of the invention and constitute a part of this specification, illustrate embodiments of the invention and together with the description help to explain the principles of the invention. In the drawings.

DETAILED DESCRIPTION

Figure 2:
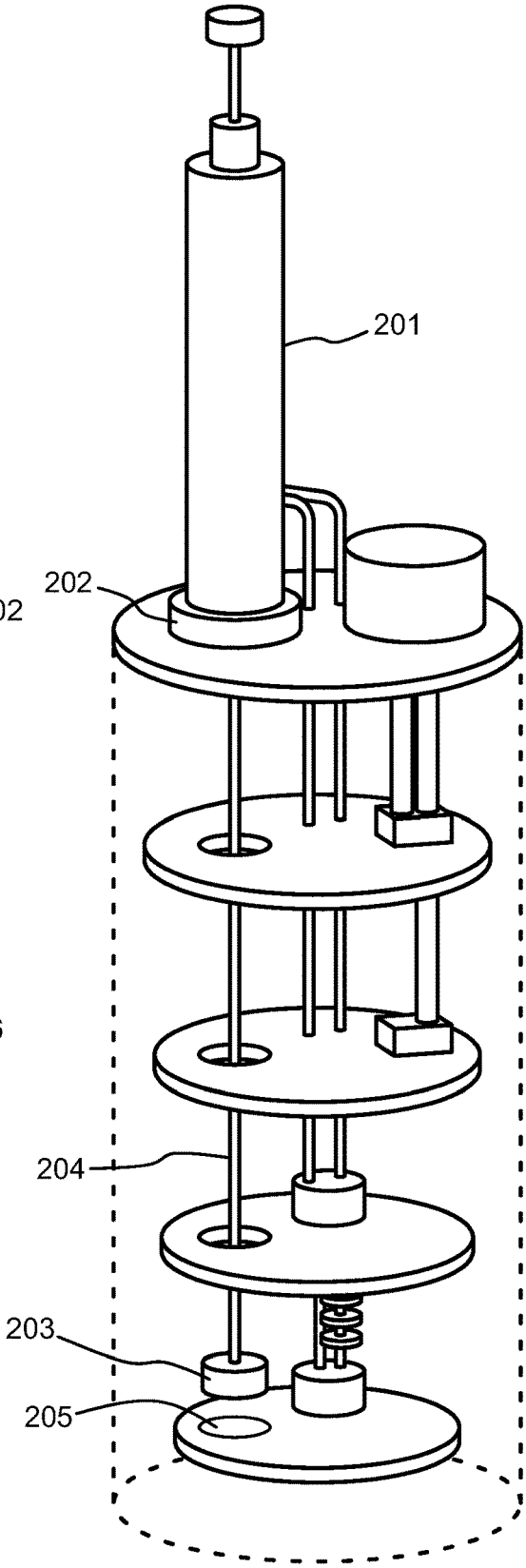
Fig. 2 PRIOR ART
FIG. 2 is a schematic illustration of cryostat equipped with a dilution refrigerator and a sample changer.
Figure 3:
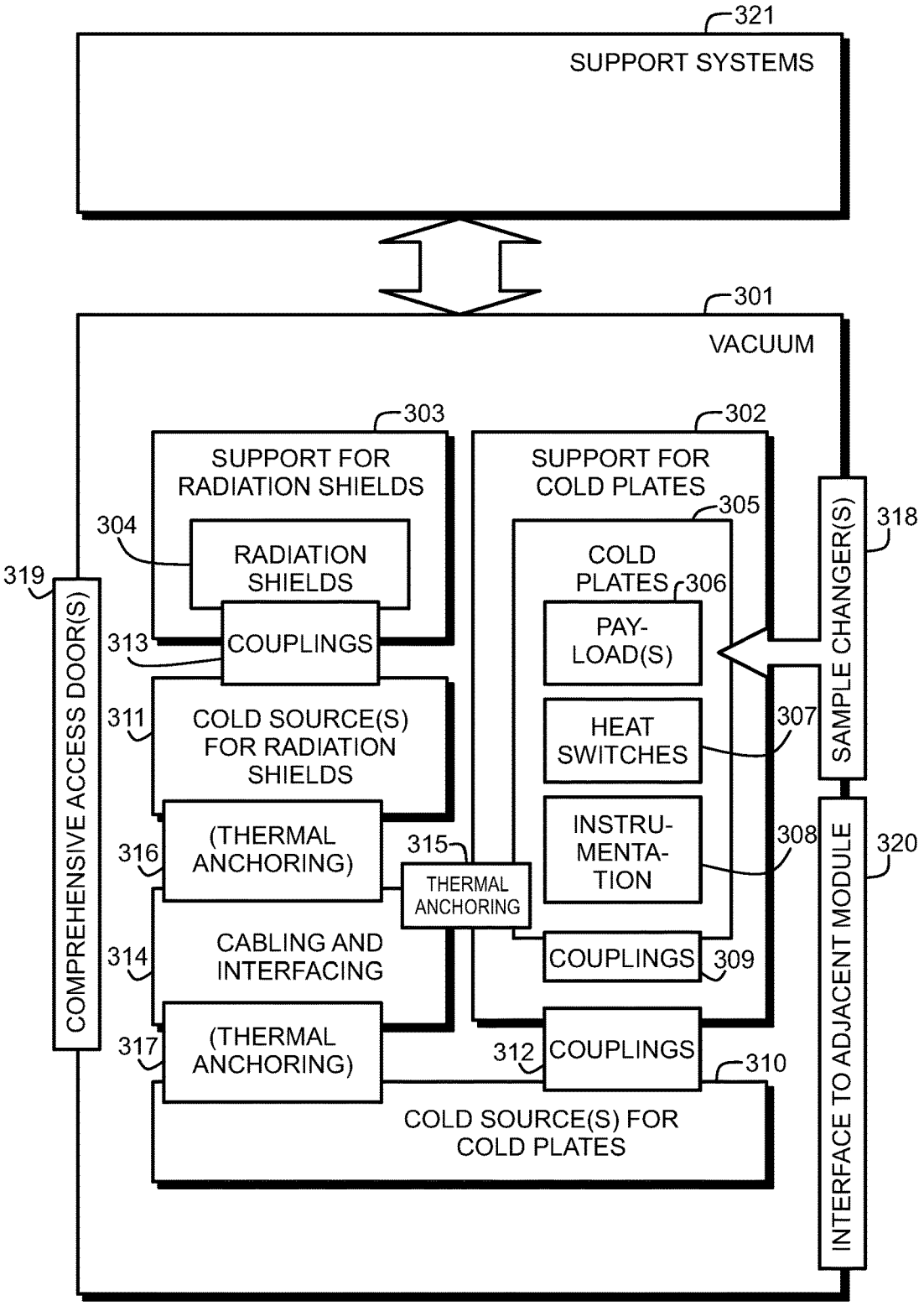
FIG. 3 illustrates schematically some parts of a cryogenic cooling system.

FIG. 3 is a schematic illustration of a cryogenic cooling system. As the system incorporates significant new aspects that go beyond conventional ways of thinking on this technical field, the term cryogenic platform may be introduced. In the terminology used here, a cryogenic platform represents a next step in size and versatility from conventional cryogenic cooling systems that followed the strictly nested approach explained above with respect to FIGS. 1 and 2. For example, a cryogenic platform may be largely agnostic with regard to which kind(s) of cold sources are used, and may allow exchanging previously used cold sources with new ones and/or selecting the number and type of cold sources for each use case separately. Compared to the previously introduced terminology where a cryostat was a simple vacuum can with a cold source and a cryogenic cooling system was a more elaborate apparatus with an outer cold source for pre-cooling and inner cold source for cooling to base temperature, a cryogenic platform may have two or more such hierarchical levels of cooling and/or two or more parallelly operating cold sources on any or each hierarchical level.

The largest block in the background in FIG. 3 represents a vacuum chamber 301. The size, shape, and basic structural solution of the vacuum chamber 301 need not be discussed in more detail here, although it may be pointed out that certain intelligent choices regarding shape and basic structural solution may offer great advantages compared to more conventional solutions like those discussed earlier with reference to FIGS. 1 and 2. Such intelligent choices may also help in scaling up the system or platform to significantly larger sizes than more conventional cryostats, while simultaneously involving important advantages concerning serviceability and practical use. Examples of such intelligent choices regarding shape and basic structural solutions are described in more detail later in this text.

According to FIG. 3, inside the vacuum chamber 301 are two support systems 302 and 303. For purposes of unambiguous reference, these may be called the first support system 302 and the second support system 303. The first support system 302 is for cold plates and the second support system 303 is for heat radiation shields. The first and second support systems 302 and 303 need not be completely separate from each other. In other words, some structural elements may have a role in both support systems. However, for reasons explained in more detail below, it is advantageous to have the support system of the radiation shields exhibit at least some structural features that are independent of the cold plates. In conventional cryostats a typical form and structure of a heat radiation shield has been that of a uniform cylindrical shell closed at one end. Such a conventional heat radiation shield is typically supported by attaching it to a corresponding cold plate by the edge of its open end.

The presence of the first and second support systems 302 and 303 in a cryogenic cooling system or platform schematically shown in FIG. 3 offers advantages over the more conventional approach. First, it allows building at least one or some of the heat radiation shields—or even all of said heat radiation shields—so that they remain thermally insulated from the respective cold plate or at least a part thereof. When the heat radiation shield is not directly supported by the corresponding cold plate, these two may remain thermally apart, without direct mechanical (i.e. thermally conductive) contact to each other. Second, it allows constructing at least one or some of the heat radiation shields—or even all of said heat radiation shields—of modular parts that may be attached in place and detached in smaller portions than the whole heat radiation shield at once. This, in turn, may allow easier physical access to inner parts of the cryogenic cooling system or platform than in conventional systems, because in order to get physical access, one does not necessarily need to disassemble and remove the whole heat radiation shield but only a part of it. Third, it brings about the possibility of using dedicated cold sources 7 for heat radiation shields and cold plates separately.

Heat radiation shields are generally represented by block 304 in FIG. 3.

Cold plates are generally represented by block 305 in FIG. 3. In certain resemblance to the conventional approach shown in FIGS. 1 and 2, the cold plates 305 are a plurality of essentially plate-formed structures, located parallel to each other and displaced from each other in a certain first direction that is perpendicular to the cold plates. It is possible—but not obligatory—that each of the cold plates 305 represents a temperature stage within the vacuum chamber 301, so that one of the cold plates 305 is the so-called base temperature plate, i.e. the part of the cryogenic cooling system or platform that can be made the coldest. Proceeding from such a base temperature plate in said first direction, there are consecutive cold plates of higher and higher temperatures.

As a non-limiting example, if a dilution refrigerator is used to cool the base temperature plate to only some millikelvins, the mixing chamber of the dilution refrigerator is located on the base temperature plate. Proceeding in said first direction there may be a 100 mK plate, a still plate (on which the still of the dilution refrigerator is located), a 4 K plate (to which the lower stage of a mechanical refrigerator is thermally coupled), and a 50 K plate (to which the upper stage of the mechanical refrigerator is thermally coupled).

Each cold plate may be said to define a subspace adjacent to it. As there typically is a corresponding one of the heat radiation shields 304 associated with a respective one of the cold plates 305, such heat radiation shield may be said to be configured to shield the respective subspace adjacent to the corresponding one of the cold plates 305.

Figure 1:
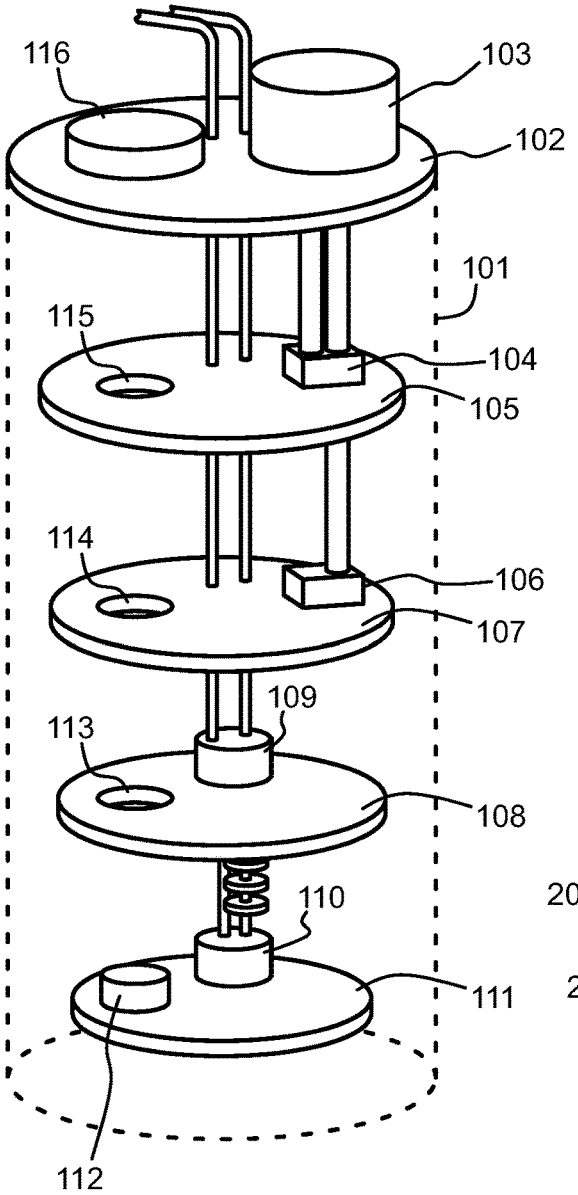
Fig. 1 PRIOR ART
FIG. 1 is a schematic illustration of a cryostat equipped with a dilution refrigerator.

As a difference to the conventional approach shown in FIGS. 1 and 2, in which each cold plate is an essential uniform entity, at least one or some of the cold plates 305 may be modular cold plates. A modular cold plate is one that comprises two or more sections adjacent to each other. The fact that together they still form a single cold plate, if only a modular one, is taken to mean that when looking at the arrangement of cold plates 305 as a whole, the sections are on the same level in said first direction.

Some important advantages can be achieved by coupling the sections of a modular cold plate to the first support system 302 independently of each other. Being coupled to the first support system 302 independently of other sections of the same modular cold plate means that such a section can, if desired, be attached in place to the first support system 302 and detached therefrom irrespective of how the other section(s) of the same cold plate are simultaneously handled. Possibly, but not obligatorily, it may also have consequences to the strength of the thermal coupling between the sections of a cold plate. This aspect is discussed in more detail later in this text.

Typically the base temperature plate, but additionally or alternatively also one or more of the other cold plates, offers a location for attaching one or more payloads as illustrated with block 306 in FIG. 3. Payloads 306 may comprise for example scientific experiments, quantum computer components, measurement setups and/or other kinds of devices and arrangements that require a particular temperature for appropriate operation. Also coupled to and/or between cold plates may be for example heat switches 307, with which one can control the thermal conductivity between cold plates, as well as various kind of instrumentation 308 such as thermometers, temperature control elements, sensors, circuits needed for connections, and the like.

In general, also components attached to other cold plates than just the base temperature plate can be regarded as payloads. For example, assuming that the cryogenic cooling system or platform is used to cool a quantum computer, there may be a base temperature payload that comprises those components that are most critically in need of lowest temperatures, like quantum processing units, travelling wave parametric amplifiers, and the like. At a 4 K stage could be another piece of payload, comprising for example HEMT (high electron mobility transistor) amplifiers, filters, and the like. Attenuators, filters, heat exchangers and the like may be located at almost any temperature stage according to need.

Couplings 309 are schematically shown between the cold plates 305 and the first support system 302. As with all other couplings in FIG. 3, thermal couplings are particularly meant here. As already noted above, there may be thermal couplings of various (and in some cases variable) also between cold plates, and even between sections of an individual cold plate. In order to have best freedom to deliberately design the last-mentioned, it is advantageous if the sections of a modular cold plate are made so (and attached to the first support system 302 so) that mutually adjacent edges of the sections do not touch each other. If desired, a separate coupling member may then be utilised to couple such mutually adjacent edges of the sections of a modular cold plate together. Non-limiting examples of such a coupling member include, but are not limited to, a stainless steel strip that bridges the gap between the adjacent edges, a thermal coupling block, or a shelf support that is part of said first support system and supports said sections by their adjacent edges.

Above it was already noted that one of the advantages brought about by the separate first and second support systems 302 and 303 involves having dedicated cold sources for at least some of the cold plates and the heat radiation shields. As a reminder, in prior art solutions like that in FIG. 1, for example the lower stage 106 of the mechanical pre-cooler cools a respective cold plate 107, which in turn cools the radiation shield that is not shown in FIG. 1 but is expected to appear as a cylindrical can hanging from the cold plate 107 by the edge of its open end. Thus, in such prior art systems, the same cooling power is available for cooling both the cold plate and its radiation shield, and the cold plate and radiation shield will eventually be at the very same temperature.

In a cryogenic cooling system or platform like that in FIG. 3, there may be one or more cold sources 310 dedicated to respective cold plate(s) 305, and one or more cold sources 311 dedicated to respective heat radiation shields 304. In this respect, a dedicated cold source is one, the cooling effect of which is particularly targeted to the respective cold plate(s) or heat radiation shield(s). As cold sources there may be for example one or more mechanical coolers such as pulse tube refrigerators, Gifford-McMahon coolers, Stirling coolers, or the like. Additionally or alternatively there may be one or more Joule-Thomson coolers, dilution refrigerators, magnetocaloric coolers, and/or other kinds of cooling apparatuses. In addition to or in place of mechanical coolers, one or more baths of liquid cryogen can be used. The possible use of liquid cryogens as at least some of the cold sources may be characterised as possibly utilizing large-scale distributed cooling solutions in addition to or in place of the point-wise cooling represented by mechanical coolers.

In an advantageous embodiment, the cryogenic cooling system or platform comprises a first dedicated cold source configured to cool at least some of the heat radiation shields 304 without cooling any of the cold plates 305, and a second dedicated cold source configured to cool at least some of the cold plates 305 without cooling any of the heat radiation shields 304. Saying that a cold source cools a first part without cooling a second part means that there is no intended thermally conductive coupling, or at most a very small thermally conductive coupling, between the cold source and such a second part—to be quite exact, as thermal energy is exchanged between internal parts of a cryostat at least in the form of radiation through vacuum, it is not feasible to say that a cold source dedicated to a first part would not cool a second part at all.

Cooling a heat radiation shield with a different cold source than the cold plate associated with that heat radiation shield may bring about important advantages. One of them is that the temperatures of the heat radiation shield and the cold plate can be decided separately, even during operation. Also, the absence of a thermally conductive coupling between the heat radiation shield and the respective cold plate typically also means absence of direct mechanical contact, so vibrations caused by a mechanical cooling apparatus of the heat radiation shield are not forwarded to the cold plate, at least not as easily as if there would be only a common mechanical cooler for the two.

FIG. 3 shows schematically the couplings 312 between the first support system 302 and the cold source(s) 310 for the cold plates. It is also possible, and in many cases very desirable, to have thermally conductive couplings directly between the cold plates 305 and the cold source(s) 310 for the cold plates. Similarly, FIG. 3 shows schematically the couplings 303 between the heat radiation shields 304 and the cold source(s) 311 for the heat radiation shields. These may be direct, as schematically indicated in FIG. 3, and/or they may go at least partly through parts of the second support system 303.

A thermally conductive coupling of a kind meant above is typically implemented either by attaching the two parts firmly together or by connecting them with a thermal conduction member, such as a braid of copper or silver strands. Actuatable mechanisms may be used for such attaching, so that the attaching can be made remotely if needed. Simple attaching, in turn, may consist of simply bolting the two parts together or using some other kind of mechanical connector when the parts are accessible. In some cases, a thermally conductive coupling can be made through a fluid medium such as exchange gas, but that naturally necessitates some means for containing the fluid member and limiting its thermally conductive effect to between only those parts that it is meant to couple thermally.

Block 314 in FIG. 3 represents cabling and interfacing. According to an interpretation, cabling and interfacing could be considered to belong to the payloads of block 306 and/or to the instrumentation of block 308. As cabling and interfacing typically involves making connections between different parts within the cryogenic cooling system or platform, which parts may be a largely different temperatures during operation, it is advisable to use thermal anchoring. As a concept, thermal anchoring means making thermally conductive couplings between a selected component and a cold source, so that any heat loads represented by said component will become absorbed (at least to a significant extent) by such cold source. Typically, as schematically illustrated by block 315 in FIG. 3, cold plates 305 and/or their support system 302 may be used for thermally anchoring the cabling and interfacing parts 314. Additionally or alternatively, thermal anchoring of the cabling and interfacing parts 314 may utilize more direct couplings to the cold sources 311 and 310 of the radiation shields 304 and the cold plates 305 respectively, as schematically illustrated by blocks 316 and 317 in FIG. 3.

It is possible, but not obligatory, to equip the cryogenic cooling system or platform of FIG. 3 with one or more sample changers, as schematically illustrated by block 318. A sample changer means an arrangement that enables inserting and removing one or more payloads without compromising the vacuum in the vacuum chamber 301 and without warming up the whole of its inside. Sample changers are known as such and need not be described in more detail here. If used, sample changers may be either of the top-loading type, with the sample inserted through aligned apertures in all respective cold plates, or of the bottom-loading type, with the sample inserted directly to the base temperature plate without having to go through other cold plates.

Block 319 in FIG. 3 represents one or more access doors, through which the inside of the vacuum chamber 301 may be accessed. When closed, the access door(s) 319 seal the vacuum chamber 301 so that it can be pumped to at least high vacuum ($10^{-1}$ . . . $10^{-5}$ Pa), preferably to Ultra-high vacuum ($10^{-5}$ . . . $10^{-10}$ Pa), or even to Extremely high vacuum ($<10^{-10}$ Pa). As a difference to conventional cryogenic cooling systems like those in FIGS. 1 and 2, accessing the inside of the vacuum chamber 301 does not require removing the main body of the vacuum chamber.

A form of the typical vacuum chamber 301 has a top, a bottom, and a plurality of connected side surfaces between said top and bottom. According to an advantageous embodiment, at least one of said side surfaces is a flat surface. This is advantageous from the mechanical viewpoint, because a comprehensive access door is easier to build in a flat surface so that on one hand opening the access door offers a large aperture through which many parts inside can be easily accessed, and on the other hand closing the access door tightly enough for establishing the vacuum conditions inside can be done with reasonable effort.

According to an advantageous embodiment, the vacuum chamber has a constant polygonal cross section in the direction that was characterised as the first direction previously in this text. Regarding the top, bottom, and plurality of connected side surfaces of the vacuum chamber, said constant polygonal cross section means that the side surfaces are all flat surfaces, i.e. they appear as the side lines of the polygon in the cross section. The polygon may have any number of sides and corners, although a square, a hexagon, and an octagon are advantageous alternatives because of reasons that are described in more detail later in this text.

The more flat side surfaces there are in the vacuum chamber, the more abundant are the possibilities of easily providing comprehensive access doors. According to an advantageous embodiment, every second flat side surface or even every flat side surface of the vacuum chamber comprises an access door. In particular, if the vacuum chamber is very large, it may be advisable to have comprehensive access doors on a plurality of sides thereof, so that parts inside the vacuum chamber are easily accessible regardless of their position in relation to the side surfaces of the vacuum chamber.

According to a large-scale modular approach, the vacuum chamber 301 may constitute a module of a larger modular cryogenic cooling system or platform. It is possible, but not obligatory, that the vacuum chamber 301 comprises one or more interfaces to adjacent modules of the cryogenic cooling system or platform. Such interfaces are schematically represented by block 320 in FIG. 3. Examples of such interfaces are described in more detail later in this text.

Block 321 in FIG. 3 represents schematically all such support systems of the cryogenic cooling system or platform that are located outside the vacuum chamber 301. Such support systems include but are not limited to for example mechanical support, vacuum pumps, circulation systems of gases and/or cryogenic liquids, operating power, control electronics, communication connections, and the like. According to the large-scale modular approach outlined above, in which the vacuum chamber 301 constitutes a module of a larger modular cryogenic cooling system or platform, some or all of the support systems 321 may be shared among some or all modules of the larger modular cryogenic cooling system or platform. If the cryogenic cooling system or platform is very large, the support systems 321 may comprise stairs, ladders, catwalks, and/or other similar structures designed to aid an operator to access the various parts. Such access aids may be removable for allowing them to be utilized at the most appropriate location at any time.

Figure 4:
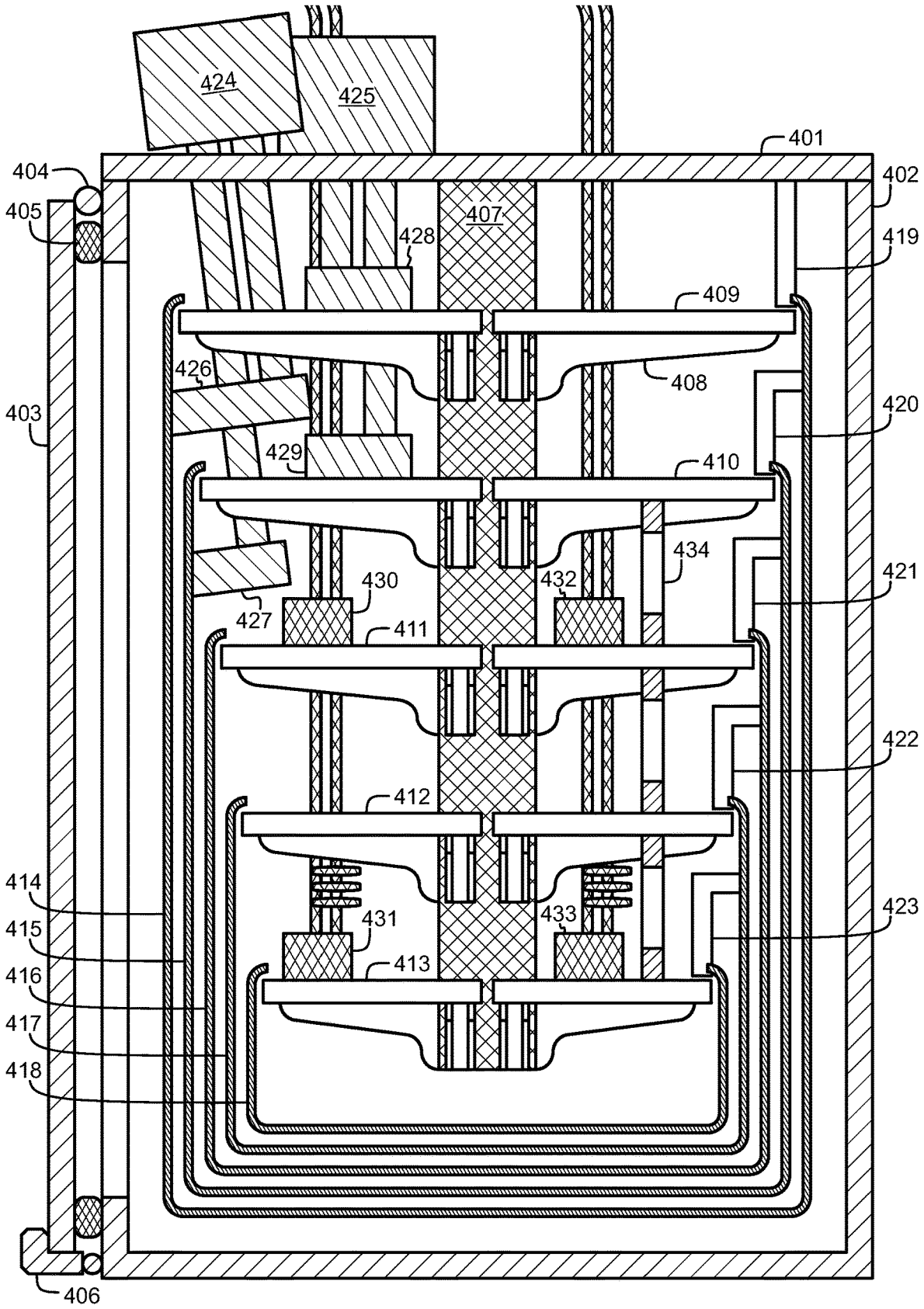
FIG. 4 illustrates schematically some parts of a cryogenic cooling system.

FIG. 4 is a schematic cross section of a cryogenic cooling system or platform according to an embodiment. The outer perimeter in FIG. 4 illustrates the vacuum chamber, which in FIG. 4 comprises a top 401, a body 402, and at least one comprehensive access door 403. Hinges 404, vacuum seals 405, and a closing mechanism 406 of the comprehensive access door 403 are schematically shown in FIG. 4. Although the dimensions in FIG. 4 are just indicative, when the aperture covered by the comprehensive access door 403 spans a majority of a side surface of the vacuum chamber it truly offers comprehensive access to at least that side of all structures inside the vacuum chamber.

Supported from the top 401 of the vacuum chamber is a support column 407, the longitudinal (vertical) direction of which constitutes what was designated the first direction earlier in this text. At various levels along the support column 407 are shelf supports, an example of which is the shelf support 408 in FIG. 4. The support column 407 and the shelf supports 408 are parts of what was designated as the first support system 302 in FIG. 3. As said first direction is a direction of a large temperature gradient inside the vacuum chamber during operation, it is advantageous to make the support column 407 of a material (or materials) having low thermal conductivity. Non-limiting examples of such materials include but are not limited to thin-walled stainless steel and hardened polymer resin. It may prove advantageous to assemble the support column 407 from longitudinal sections with thermal insulators between them, and/or provide a thermally insulating attachment between the support column 407 and the top 401 to decrease the heat flow down the support column 407 towards the cold parts inside the vacuum chamber during operation.

The shelf supports 408 support the cold plates, of which there are five in this schematic example, shown with reference designators 409, 410, 411, 412, and 413. In the embodiment of FIG. 4, all cold plates 409 to 413 are modular cold plates. In other words, each cold plate comprises of two or more sections adjacent to each other on the same level in said first direction, the sections being coupled to the first support system independently of each other. In this embodiment, as schematically shown against the middle of the support column 407, the mutually adjacent edges of the sections of each cold plate do not touch each other. Additionally, there are dedicated shelf supports 408 for each section. This helps to reduce the thermal coupling between the sections of an individual cold plate, which allows e.g. maintaining the sections at (at least slightly) different temperatures despite belonging to the same cold plate.

As any external heat load is most critical to the coldest cold plates, it is possible to construct the support system in an alternative way, in which there is no continuous support column all the way down to the coldest parts. In such an alternative approach, a support column could continue from the top 401 of the vacuum chamber to some intermediate cold plate. The further cold plates downwards therefrom may then be supported sequentially from each other using supports made of materials that conduct as little heat as possible at low temperatures. Such separately supported cold plates may be either uniform or modular, so that in the latter alternative a section of a colder plate is only supported from (the section of) the next warmer cold plate closest to it.

Five nested heat radiation shields 414, 415, 416, 417, and 418 are schematically shown in FIG. 4. Each heat radiation shield 414 to 418 is configured to shield a respective subspace adjacent to a corresponding one of the cold plates 409 to 413 respectively. In this schematic representation, the shielded subspace is under the respective cold plate.

A support system, corresponding to the second support system 303 in FIG. 3, is shown schematically to comprise support struts 419, 420, 421, 422, and 423. As the nested heat radiation shields are to be kept at different temperatures during operation, it is advantageous to design and construct the second support system so that it does not cause an unnecessary heat load to the cold parts inside the vacuum chamber. As schematically shown by support strut 419 in FIG. 4, the outermost radiation shield 414 (often referred to as the 50 K shield after its typical temperature) may be supported from structures of the vacuum chamber, for example from the top 401, using materials of low thermal conductivity. While it would basically be possible to support also the inner radiation shields directly from structures of the vacuum chamber, it may be more advantageous to construct the second support system so that it establishes thermal anchoring at the level of each (or at least some) of the heat radiation shields. Such thermal anchoring then intercepts any possible heat flows that would otherwise occur through the second support system.

The cryogenic cooling system or platform schematically shown in FIG. 4 comprises two mechanical coolers 424 and 425. Of these, mechanical cooler 424 is an example of a dedicated cold source configured to cool at least some of the heat radiation shields without (directly) cooling any of the cold plates. The upper stage 426 of the mechanical cooler 424 is shown as directly coupled to the outermost heat radiation shield 414, and the lower stage 427 is shown as directly coupled to the next inner heat radiation shield 415. Assuming, as a non-limiting example, that the mechanical cooler 424 is a pulse tube refrigerator capable of maintaining its upper stage at 50 K and its lower stage at 4 K during operation, this way the two outermost heat radiation shields can be kept approximately at said temperatures respectively.

The other mechanical cooler 425 is an example of a dedicated cold source configured to cool at least some of the cold plates without (directly) cooling any of the heat radiation shields. The upper stage 428 of the mechanical cooler 425 is shown as directly coupled to (one section of) the top cold plate 409, and the lower stage 429 is shown as directly coupled to (one section of) the next upper cold plate 410. Making the same assumptions as above, and assuming some kind of thermal coupling between the sections of the respective cold plates, this would allow maintaining the two top cold plates at approximately 50 K and 4 K respectively during operation.

It is possible to have separate cold sources coupled to sections of a cold plate. For example, if one would add another mechanical cooler like that shown as 425 to FIG. 4 and place it on the right-hand side of the support column 407, such a further mechanical cooler (or some other corresponding cold source) could be used to cool the right-hand sections of the to top cold plates independently of the cooling of the left-hand sections of said cold plates.

The principle of having two separate cold sources for sections of a cold plate is explicitly shown in the case of the two further cold sources schematically shown in FIG. 4. These are a first dilution refrigerator and a second dilution refrigerator. The first dilution refrigerator is configured to cool a first subsection of a target region located on one of the cold plates. Correspondingly, the second dilution refrigerator is configured to cool a second subsection, thermally insulated from the first subsection, of the target region.

In the example of FIG. 4, the target region is the subspace adjacent to the lowest cold plate 413. The first subsection referred to above is the subspace adjacent to its left-hand section, and the second subsection is the subspace adjacent to its right-hand section. To achieve the cooling in the manner described above, the still 430 of the first dilution refrigerator is located in and attached to the left-hand section of the middle cold plate 411 and the mixing chamber 431 of the first dilution refrigerator is located in and attached to the left-hand section of the lowest cold plate 413. The still 432 of the second dilution refrigerator is located in and attached to the right-hand section of the middle cold plate 411 and the mixing chamber 433 of the second dilution refrigerator is located in and attached to the right-hand section of the lowest cold plate 413.

While the mixing chambers of both the first and second dilution refrigerators could basically be capable of reaching the same very low base temperature in the target region, it may be advantageous to use them differently. For example, the first subsection of the target region may comprise a thermalization (i.e. thermal anchoring) stage of connections between the target region and warmer parts of the cryogenic cooling system or platform. The second subsection of the target region may then comprise the actual payload area. This way the heat load coming from the connections can be dealt with within the first subsection, which may then allow the second subsection reach and maintain even lower temperatures than it could if it had the connections coupling it directly (in the thermal sense) to the warmer parts.

Dilution refrigerators require pre-cooling down to about 4 K before they can start operating. If the mechanical coolers (or other pre-cooling cold sources) are only directly coupled to some of the upper cold plates, heat switches between the lower cold plates can be used to controllably establish and cut thermal couplings. In FIG. 4, heat switches are schematically shown coupling the (right-hand sections of) the four lowest cold plates together. Of these, the topmost heat switch 434 is shown as an example. The technology of heat switches and their use to controllably establish and cut thermal couplings between cold plates is known as such and does not need to be described further. Depending on the sectioning of the cold plates and the number of coupling of cold sources, heat switches may also be used between adjacent sections of the same cold plate. In the first direction, heat switches do not need to go always just from a cold plate to the next adjacent cold plate, but they can be used to controllably couple cold plates further from each other, as is known from the art.

Figure 5:
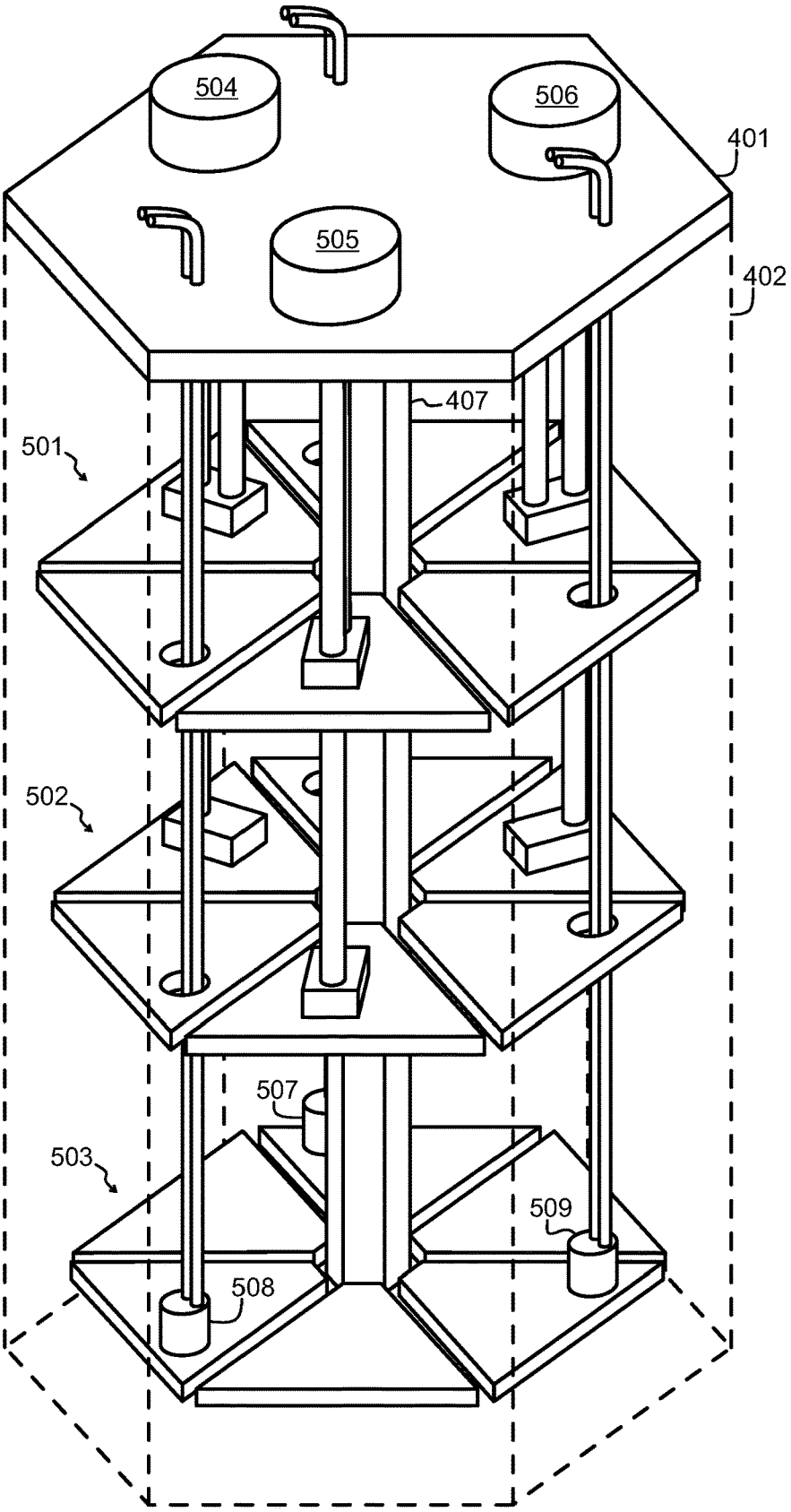
FIG. 5 illustrates schematically some parts of a cryogenic cooling system.

FIG. 5 shows a simplified, schematic axonometric view of a cryogenic cooling system or platform, for facilitating easy comparison to the prior art systems of FIGS. 1 and 2. Heat radiation shields are not shown in FIG. 5 for reasons of graphical clarity; also, the cryogenic cooling system or platform is only shown to comprise three levels of cold plates. These simplifications are not to be taken as restrictions.

FIG. 5 shows the top 401 of a vacuum chamber, as well as the outline of a body 402 of the vacuum chamber with dashed lines. Supported from the top 401 is a support column 407 which, together with shelf supports not shown in FIG. 5, is part of the first support system for supporting the cold plates. Each of the three cold plates 501, 502, and 503 is a modular cold plate comprising two or more sections adjacent to each other on the same level in the first direction, said sections being coupled to said first support system independently of each other.

Three mechanical coolers 504, 505, and 506 are shown, each of them constituting a cold source for a respective set of cold plate sections. Of the mechanical coolers 504, 505, and 506, each has an upper stage coupled to a respective section of the top cold plate 501 and a lower stage coupled to a respective section of the middle cold plate 502. Three base-temperature cold sources 507, 508, and 509 are shown, each configured to cool a respective subsection of the target region. In resemblance with what was said about FIG. 4 above, the three base-temperature cold sources 507, 508, and 509 may each cool a respective part of an actual payload, or at least one of them may be used as a thermalization (i.e. thermal anchoring) point for connections between the other subsections of the target region and warmer parts of the system.

In the embodiment of FIG. 5, the vacuum chamber has a constant polygonal (in particular: hexagonal) cross section in a plane perpendicular to the first (i.e. vertical) direction. In other words, the vacuum chamber has a top, a bottom and a plurality of connected side surfaces between the top and bottom, of which in this embodiment all (six) side surfaces are flat surfaces. Also in the embodiment of FIG. 5, the sections of the cold plates are basically equilateral triangles, possible with some of that corner cut away that is closest to the support column 407. If there is a comprehensive access door on each side surface of the vacuum chamber, it is easy to take advantage of the modularity of the cold plates by each time accessing that side that needs attention. Sections of cold plates may be serviced, removed, and replaced without having to disassemble very large portions of the cryogenic cooling system or platform.

The three mechanical coolers and the three base-temperature cold sources are each shown as dedicated to a single sector in said hexagonal configuration of FIG. 5. As an alternative, at least one such cold source could be located on the division line between two adjacent sectors, in which case it is particularly easy to thermally couple such a cold source for two adjacent sections of the appropriate cold plate(s).

Figure 6:
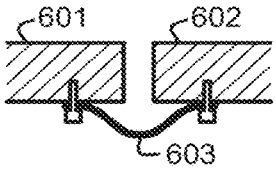
FIG. 6 illustrates one possible way of coupling the edges of sections of cold plates.
Figure 7:
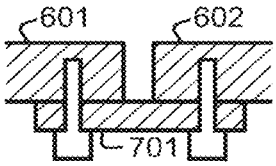
FIG. 7 illustrates one possible way of coupling the edges of sections of cold plates.
Figure 8:
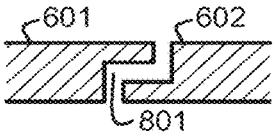
FIG. 8 illustrates one possible way of coupling the edges of sections of cold plates.

FIGS. 6, 7, and 8 elaborate upon various possibilities of thermally coupling the mutually adjacent sides of two sections 601 and 602 of a cold plate. In embodiments where the mutually adjacent edges of such two sections do not touch each other, various possibilities exist for determining the extent of thermal coupling according to need. One possibility is to make a coupling member couple the mutually adjacent edges of the sections to each other. In FIG. 6, such a coupling member comprises a thin strip 603 of stainless steel, edges of which are bolted or otherwise attached to the respective edges of the sections. By selecting the material, thickness, size, outline, and method of attaching the stainless steel strip 603, the designer may fine tune the desired extent of thermal coupling between the sections. Alternatively, as a corresponding coupling member one may use one of the shelf supports that are part of the first support system. If a common shelf support supports two sections by their adjacent edges, it can be made to act as a coupling member, and its material, thickness, size, outline, and method of attaching may be selected accordingly.

FIG. 7 shows another alternative, in which the coupling member comprises a thermal coupling block 701. This alternative is practical for use in cases where one needs a good, solid thermal coupling between two adjacent sections of a cold plate. The thermal coupling block 701 of FIG. 7 is made of a material that is thermally highly conductive at low temperatures, such as a suitable brand of copper or silver, and it may be plated with gold or other appropriate material for ensuring best possible thermal coupling. For the same reason, the thermal coupling block 701 is firmly attached to both sections of the cold plate, for example by bolting.

FIG. 8 illustrates a further alternative, for use in cases where the thermal coupling between adjacent sections of a cold plate should be as weak as possible. There is no coupling member between the two sections 601 and 602, and the edges have been designed to form a maze 801 that cuts all direct line-of-sight paths from one side of the cold plate to the other. The last-mentioned ensures that thermal radiation from other sources, like from warmer parts at some distance on one side of the cold plate, cannot pass through the gap between sections despite there being no mechanical contact.

The principle of using maze-shaped geometries to prevent thermal radiation from passing through gaps can be used also at other parts of the cryogenic cooling system or platform where two components are located close to each other but are not touching. As an example, one may consider the upper edges of each of the heat radiation shields 414-418 earlier in FIG. 4. Although the graphical representation in FIG. 4 is highly schematic, it nevertheless represents a thinking according to which the edge of the heat radiation shield may curve above the edge of the cold plate, forming a maze-like geometry therebetween. Based on these instructions, the skilled person is capable of designing appropriate maze-like geometries at those parts of the cryogenic cooling system or platform where their use is advantageous.

Figure 9:
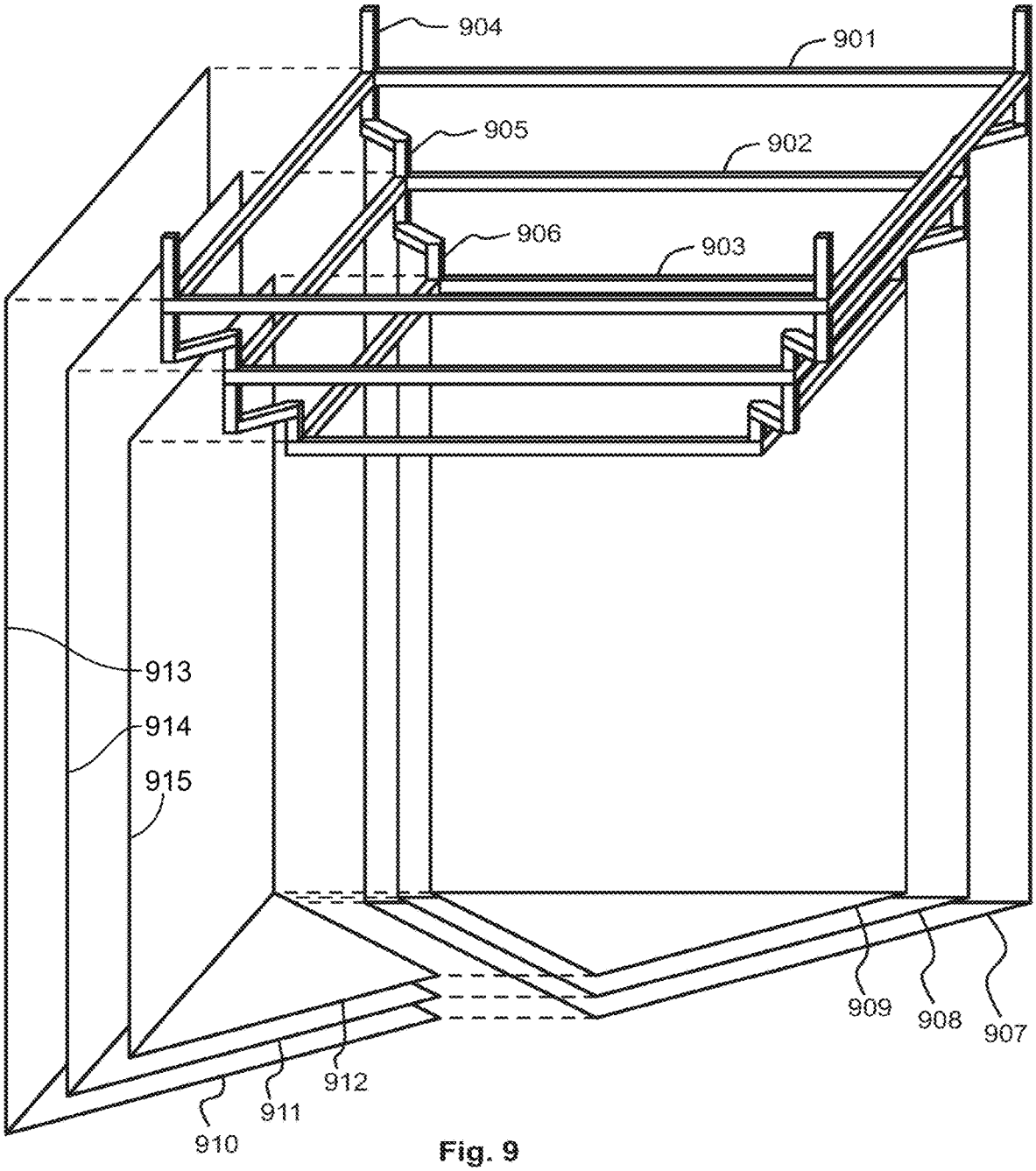
FIG. 9 illustrates an example of a support system for heat radiation shields.

FIG. 9 illustrates a non-limiting example of how certain features of the second support system and the heat radiation shields can be implemented in practice. As a difference to FIG. 5, in FIG. 9 it is assumed that there are four side surfaces in the vacuum chamber, i.e. that the polygonal cross section in the plane perpendicular to the first direction is a rectangle, and that the heat radiation shields have similarly shaped (i.e. rectangular) cross sections. Shown in FIG. 9 is a support structure that comprises rectangular rims, of which rims 901, 902, and 903 are shown. Upwards extending support struts at the corners of the largest rim, of which support strut 904 is shown as an example, offer means for mechanically connecting the support structure to the top of a vacuum chamber (not shown in FIG. 9). Further support struts, of which support struts 905 and 906 are shown as examples, support each smaller rim so that each smaller rim in the sequence of rims is supported from the next larger rim above it.

The rims 901, 902, and 903 are made of material(s) of high thermal conductivity, while the support struts 904, 905, and 906 are made of material(s) of low thermal conductivity. Thus, parts that are thermally coupled to a common rim are likely to acquire the same temperature, while parts that are thermally coupled to different rims can be at even largely different temperatures during operation.

At least a subset of the heat radiation shields comprises sheet portions (e.g. 913, 914, 915) that are releasably coupled to the second support system and to each other. In FIG. 9, each of the heat radiation shields to be supported by the rims 901, 902, and 903 comprises four similarly formed parts. Two parts of each of said three heat radiation shields are shown in FIG. 9. Each such part comprises a vertical, rectangular portion and a triangular, horizontal portion extending perpendicularly inwards from the lower edge of the rectangular portion. On the side of the illustrated arrangement furthest away from the viewer, the three heat radiation shield parts 907, 908, and 909 are each in place, attached to the respective rim by the upper edge of the rectangular portion of the part. On the left-hand side, the three heat radiation shield parts 910, 911, and 912 are shown detached and somewhat displaced to the left. Bringing them into place as shown by the dashed lines, and adding similar heat radiation shield parts to the front and right-hand side of the arrangement, would complete the nested arrangement of three heat radiation shields, each of which just needs a corresponding cold plate to close the rectangular opening at its top.

If the basic configuration in FIG. 9 would be e.g. hexagonal like in FIG. 5 and not rectangular, the same principle could be applied by making each heat radiation shield part cover a 60 degrees sector of the hexagonal cross section. Irrespective of the number of sides in the polygonal cross section (if any), it is not necessary to have a one-to-one relationship between the number of sides and the number of heat radiation shield parts. For example, in FIG. 9 the two parts shown for each heat radiation shield could be permanently attached together to form a part that covered one half of the cross section. The remaining half could be covered by a similar combined part with 180 degrees coverage in the cross section, or by two parts of 90 degrees coverage like those seen in FIG. 9.

Notwithstanding the former, certain advantages may be gained by having a one-to-one relationship between the number of sides and the number of heat radiation shield parts. Especially on those sides on which the vacuum chamber has a comprehensive access door, it may be advantageous to have heat radiation shield parts that are of such size and shape that it is possible to attach and detach them through the respective comprehensive access door. In such an approach, each side of the cryogenic cooling system or platform thus forms a relatively independent sector, in which servicing, assembling, and disassembling can be accomplished without having to do much on the other sectors.

Figure 10:
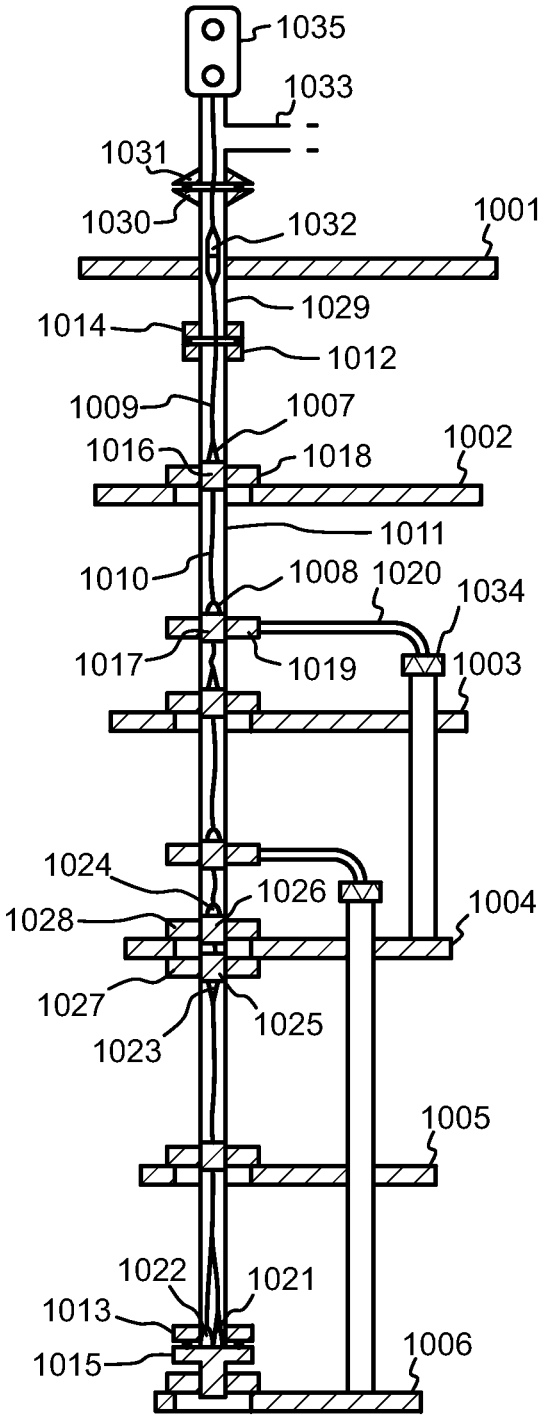
FIG. 10 illustrates an example of a cabling subsystem.

Many alternative approaches are possible for constructing the cabling inside the cryogenic cooling system or platform. As an example, one may use some of the approaches described in a co-pending European patent application No. 20213816.0, which is not yet public at the time of writing this text. FIG. 10 illustrates some possible aspects of such an approach. In the following description of FIGS. 10 and 11 the term "flange" is used to describe both a cold plate and a section of a cold plate.

FIG. 10 illustrates a number of thermal stages 1001, 1002, 1003, 1004, 1005, and 1006 of a cryogenic cooling system or platform in a partial cross section taken in a vertical plane. These may be cold plates to be held at difference temperatures during operation. The cabling subsystem described here is not in any way particular to any specific configuration of thermal stages.

As non-limiting examples of instrumentation, in FIG. 10 the reference designators 1007 and 1023 refer to temperature sensors and reference designators 1008 and 1024 refer to heaters. Examples of wired couplings are shown with reference designators 1009 and 1010.

A cabling subsystem like that schematically illustrated in FIG. 10 comprises an elongate enclosure 1011 made of a gastight material of low but finite thermal conductivity. An example of such a material is stainless steel. A low but finite thermal conductivity may be for example between 2 and 50 W/(m*K) at 100 K, between 0.2 and 5 W/(m*K) at 10 K, between 0.03 and 0.75 W/(m*K) at 1 K, between 0.003 and 0.075 W/(m*K) at 0.1 K, and between 0.0003 and 0.0075 W/(m*K) at 0.01 K.

Being gastight means that the material of the enclosure does not allow gaseous substances to leak through if the pressure difference across it is of the kind regularly encountered in ultrahigh vacuum systems. The enclosure 1011 may be for example a tube with a regular cross section, such as a circle or a regular polygon for example.

At or close to both ends of the enclosure 1011 are mechanical interfaces 1012 and 1013 for joining the enclosure 1011 to corresponding further structures of the cryogenic cooling system or platform in a gastight manner. In the example of FIG. 10 the mechanical interface 1012 at the outer end comprises a flange 1012 for joining the enclosure to a fixed flange 1014 inside the cryogenic cooling system or platform. The mechanical interface 1013 at the inner end is configured for connecting to a base temperature region inside the cryogenic cooling system or platform. As an example, the mechanical interface 1013 may comprise another flange, for which there is a mating surface 1015 that in turn is in fixed, thermally conductive connection with the base temperature flange 1006 of the cryogenic cooling system or platform.

The gastight joint between the flanges 1012 and 1014 and that between the mechanical interface 1013 and the mating surface 1015 are both gastight to the extent that they stand ultrahigh vacuum conditions. Inside the enclosure 1011, at various intermediate locations between the ends of the enclosure 1011, are so-called internal parts. In the embodiment of FIG. 10 the internal parts are inserts that are made of (or otherwise comprise) material of high thermal conductivity, such as copper for example. A high thermal conductivity may be for example at least 100 W/(m*K) at or above 10 K, at least 10 W/(m*K) at 1 K, at least 1 W/(m*K) at 0.1 K, or at least 0.1 W/(m*K) at 0.01 K.

Inserts 1016, 1017, 1025, and 1026 are shown as examples. Each insert may be e.g. a copper plug of a certain length, the outline of which matches closely the inner surface profile of the enclosure 1011. Most of the instruments mentioned above are attached to a respective one of the inserts inside the enclosure 1011. For example, the temperature sensor shown with reference designator 1007 is attached to the insert shown with reference designator 1016.

Outside the enclosure 1011 are corresponding external parts. In the embodiment of FIG. 10 the external parts are so-called clamps, of which clamps 1018, 1019, 1027, and 1028 are singled out as examples. The clamps are made of (or otherwise comprise) material of high thermal conductivity. The location of each clamp along the length of the enclosure 1011 corresponds to the location of a corresponding insert inside the enclosure 1011.

Each of the clamps 1018, 1019, 1027, and 1028 is squeezed against the corresponding insert 1016, 1017, 1025, or 1026 with a wall of the enclosure 1011 therebetween. This is more easily seen in FIG. 11, which is a partial enlarged cross section of the intermediate location where the insert 1016 is located inside the enclosure 1011 and the clamp 1018 is located outside the enclosure 1011. As schematically illustrated in FIG. 11, in particular if the material of the enclosure 1011 is malleable, the inner surface of the clamp 1018 may be squeezed against the outer surface of the insert 1016 so hard that it causes a local deformation in the wall of the enclosure 1011.

Figure 11:
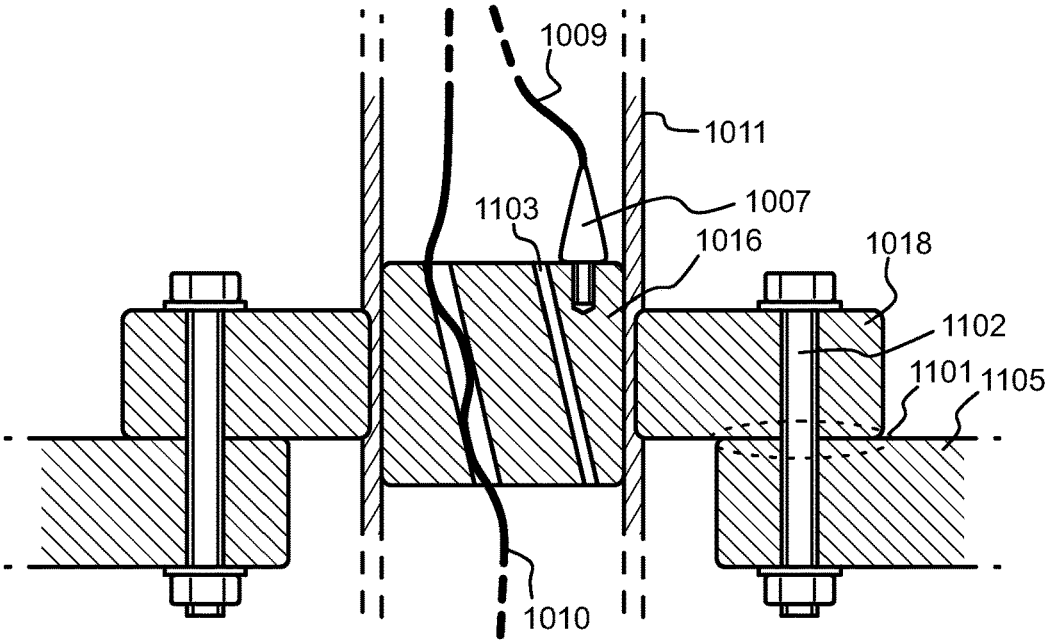
FIG. 11 illustrates an example of a detail in a cabling subsystem.

In FIG. 11 it is also seen how the clamp 1018 comprises a mechanical interface for making a thermally conductive coupling (see 1101) between the clamp 1018 and that part of the cryogenic cooling system or platform the temperature of which is to be measured with the temperature sensor 1007. A pumping hole 1103 is schematically shown in FIG. 11 going through the body of the insert 1016 for allowing gaseous media to flow through. The pumping hole 1103 (and the channel for thermalizing the through-going wire 1010) is shown at an oblique angle to emphasize that blocking (or at least significantly reducing in dimension) line-of-sight paths through the insert 1016 allows also utilizing the insert as a block of longitudinally propagating thermal radiation inside the enclosure 1011.

Parts 1016, 1018, and 1002 in FIG. 11 are all made of (or otherwise comprise) material of high thermal conductivity. Although the wall of the enclosure 1011 is made of a material of inherently low thermal conductivity, it does not create too difficult an obstacle for heat to be conducted therethrough, between the parts made of materials of high thermal conductivity.

FIG. 10 shows how one or more wires that make the wired couplings 1009 and 1010 come out of the outer end of the enclosure 1011 (and continue inside the tubular fixed part 1029 close to the top of the cryogenic cooling system or platform). In FIG. 11 the wire 1009 that conveys the signals of the temperature sensor 1007 ends at the temperature sensor 1007, while the wire 1010 that in FIG. 10 conveys the electric current to the heater 1008 continues through the insert 1016.

Reference designator 1008 in FIG. 10 shows a heater attached to the insert 1017 inside the enclosure 1011. Clamp 1019 is squeezed against the insert 1017 with the wall of the enclosure 1011 therebetween. The clamp 1019 comprises a mechanical interface for making a thermally conductive coupling 1020 to adsorption pump 1034, which is an example of a part of the cryogenic cooling system or platform that is to be heated with a heater. The thermally conductive coupling 1020 may be for example an elongate piece of material of high thermal conductivity, attached mechanically to the clamp 1019 at one end and to the adsorption pump 1034 at the other end.

The cabling subsystem shown in FIG. 10 comprises one temperature sensor 1011 that is available for a thermally conductive coupling at the inner (lower) end of the enclosure 1011. It would be possible to measure the temperature there using a similar arrangement as in FIG. 11, but in order to achieve the best accuracy it is better to avoid different material layers and material-to-material interfaces between the base temperature region and the temperature sensor to the largest extent possible. For this reason, the inner end of the enclosure 1011 is open, making the temperature sensor 1021 available for directly connecting to the base temperature region 1015, 1006 of the cryogenic cooling system or platform. This is also where the mechanical interface 1013 at the inner end of the enclosure 1011 is configured to be connected.

In the embodiment of FIG. 10 the cabling subsystem comprises also a heater 1022 available for a thermally conductive coupling at the inner end of the enclosure 1011. Similar to the temperature sensor 1021, also the heater 1022 is accessible through the open inner end of the enclosure 1011. Both temperature sensor 1021 and the heater 1022 may be attached to that part 1015 of the base temperature region that engages with the mechanical interface 1013 at the inner end of the enclosure 1011.

FIG. 10 illustrates one possible way in which the outer (upper) end of the enclosure 1011 can be constructed and joined to the other structures of the cryogenic cooling system or platform. As already mentioned above, in the embodiment of FIG. 10 there is a tubular fixed part 1029 attached to the vacuum chamber lid 1001. The inner end of the tubular fixed part 1029 comprises the flange 1014 to which the outer end of the enclosure 1011 attaches (through flange 1012) with a gastight joint capable of standing ultrahigh vacuum conditions. At the outer end of the tubular fixed part 1029 another pair of flanges 1030 and 1031 form a further joint to a connector box 1035. While this further joint needs to be reasonably gastight, it does not need to stand ultrahigh vacuum conditions, so for example a rubber O-ring can be used between the flanges 1030 and 1031.

A connector arrangement 1032 may be used inside or close to the tubular fixed part 1029 to join one or more of the wires coming out of the outer end of the enclosure 1011 to further wires to or from the connector box 1035.

The inside of the enclosure 1011 should be at vacuum during the operation of the cryogenic cooling system or platform. However, the level of vacuum inside the enclosure 1011 does not need to be as high as the ultrahigh vacuum within the main vacuum chamber. It is sufficient to have the enclosure 1011 evacuated to the extent that any gas remaining therein does not offer easier path than the enclosure walls for heat to transfer between parts that are to be held at different temperatures. FIG. 10 shows schematically a pipe fitting 1033, to which a suitable vacuum pump may be coupled. It is possible to continue vacuum pumping the enclosure 1011 during operation, but if all connections are tight enough, it is also possible to perform one-time pumping after assembling and to then keep the enclosure 1011 sealed during the rest of the operating period of the cryogenic cooling system or platform.

The arrangement utilized in the embodiment of FIG. 10 at the outer end of the enclosure 1011 allows assembling the cabling subsystem from below. When the part 1015 to which the inner end of the enclosure 1011 is to be attached is not yet in place, there is a so-called clearshot (i.e. a series of aligned apertures in the flanges 1006, 1005, 1004, 1003, and 1002) available for pushing the elongate enclosure 1011 into place from below. One may first connect the connector arrangement 1032 and then make the attachment of the outer end of the enclosure between the flanges 1012 and 1014. Thereafter one may attach all the clamps along the length of the enclosure 1011 and squeeze them against the corresponding inserts so that the wall of the enclosure 1011 remains therebetween. For this purpose it is advantageous if each clamp consists of at least two parts. Such a clamp may be assembled by bringing its parts into place on the appropriate sides of the enclosure 1011 without having to slide the clamp in place over any of the ends of the enclosure 1011.

At the inner end of the enclosure 1011 one may make the attachments of the instruments 1021 and 1022 (if any) to part 1015 and then close the joint between flanges 1013 and 1015. After completing the attachments at all mechanical interfaces where a clamp is to conduct heat to and/or from the corresponding part of the cryogenic cooling system or platform, the enclosure 1011 may be evacuated, after which the cabling subsystem is ready for operating.

Figure 12:
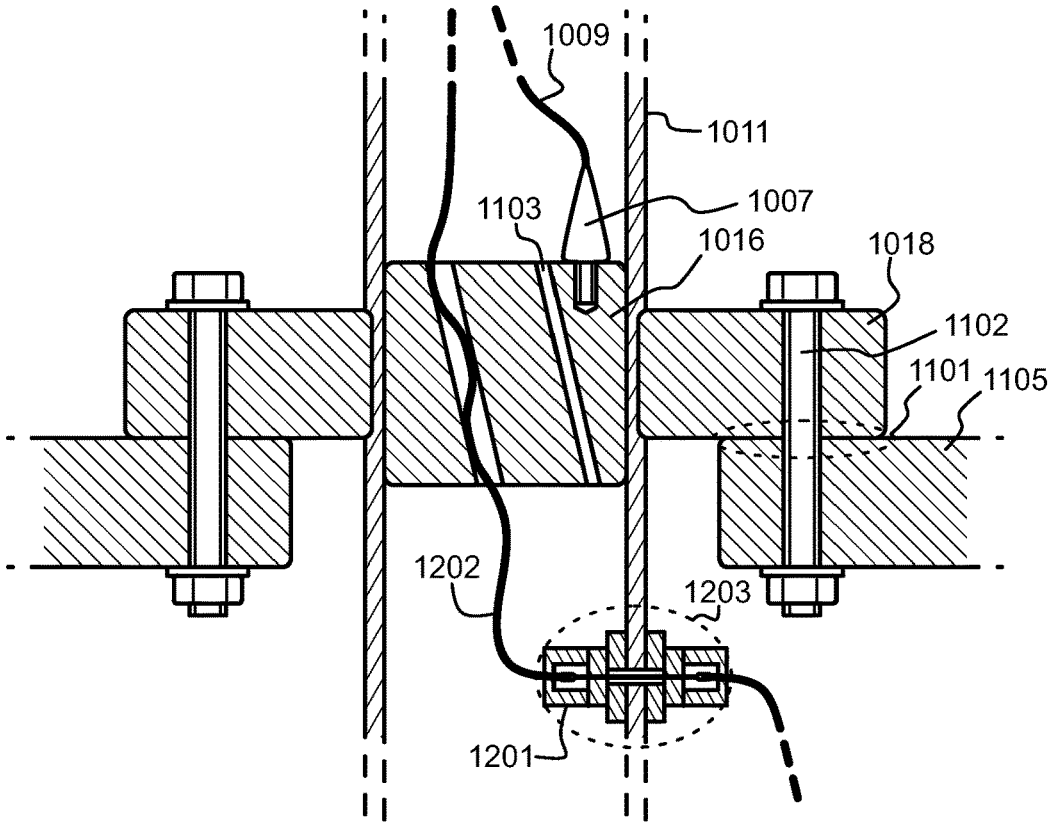
FIG. 12 illustrates an example of a detail in a cabling subsystem.

FIG. 12 illustrates an embodiment in which one of the instruments is a wired connector 1201 at the inner end of an UHV-compliant feedthrough 1203 in the wall of the enclosure 1011. A wired coupling 1202 comes to the wired connector 1201 inside the enclosure 1011. The wired coupling 1202 is attached to the internal part 1016 inside the enclosure 1011 for thermalizing it with the appropriate cooled structure, which in this example is the 50 K flange 1105 to which the external part (clamp 1018) is attached. By making wired connections of this kind at any intermediate location along the length of the elongate enclosure 1011 it is possible to tailor the cabling subsystem to many kinds of specific needs that may necessitate wired connections to components not only at the target region but also at some intermediate stages of the cryogenic cooling system or platform.

Figure 13:
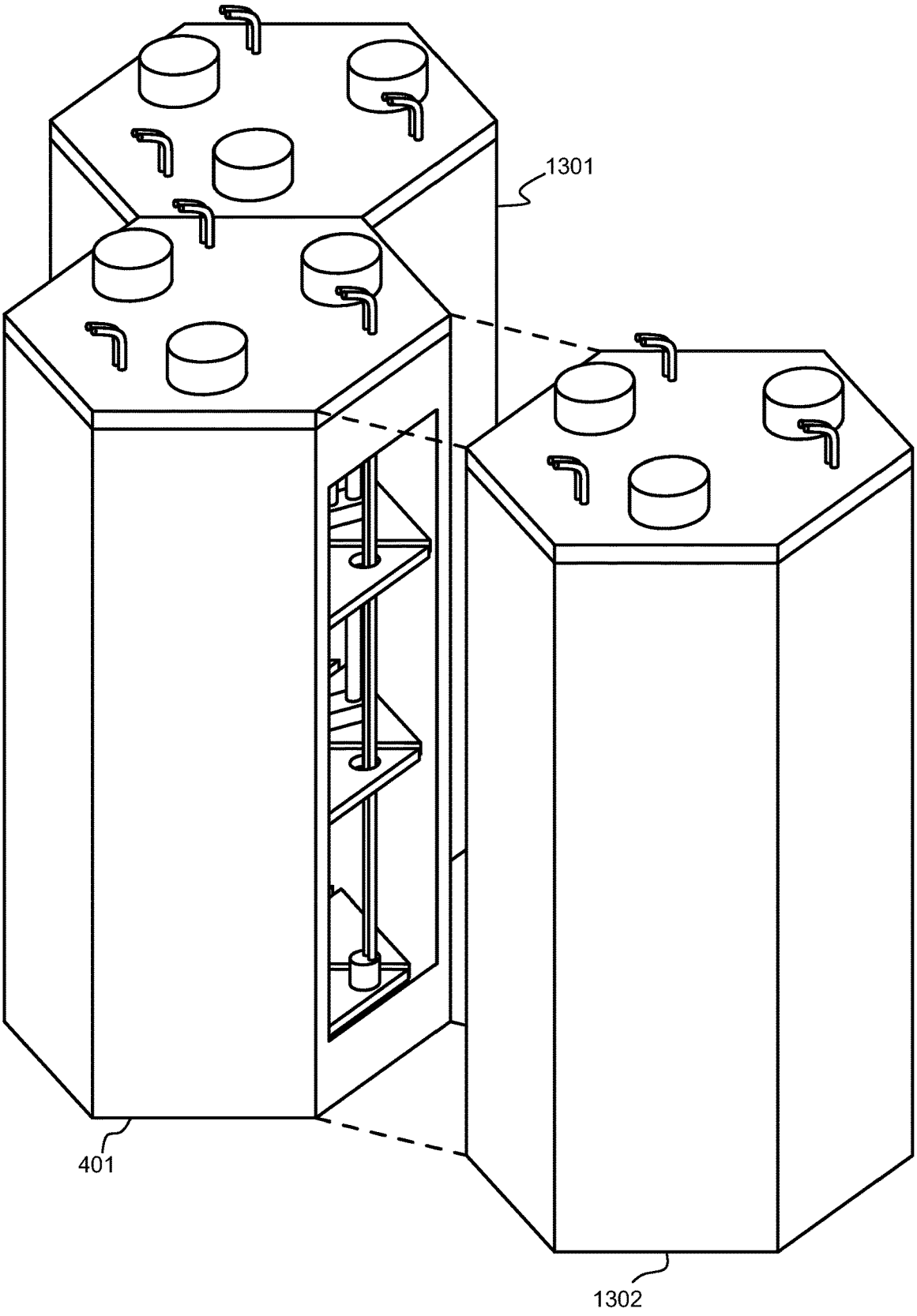
FIG. 13 illustrates a possibility of expanding a modular cryogenic cooling system.

FIG. 13 illustrates a principle of high-level modularity in a cryogenic cooling system or platform. In FIG. 13 three modules of the kind described above with reference to FIGS. 3, 4, and/or 5 are connected together. According to a formal description, a vacuum chamber as described earlier is a first vacuum chamber 401, and the cryogenic cooling system or platform comprises at least one similar vacuum chamber more. Vacuum chambers 1301 and 1302 are shown as examples in FIG. 13. Inside each of these may be a similar arrangement of support systems, cold plates, and heat radiation shields as in the first vacuum chamber 401.

FIG. 13 shows one advantage brought about by having at least one flat side surface in the vacuum chamber, or—even better—making the vacuum chamber have a polygonal cross section. Two vacuum chambers of this kind can be placed adjacent to each other, with their flat side surfaces against each other. Three or more vacuum chambers of this kind can be placed in a grid-like configuration, where the location and direction of their flat side surfaces define the form of the grid. If the vacuum chambers have a hexagonal cross section like in FIG. 13, a hexagonal grid is formed. Similarly, if the vacuum chambers would have a rectangular cross section, a rectangular grid could be formed.

Mutual couplings can be made between adjacent vacuum chambers. A relatively simple mutual coupling is an opening connecting adjacent first and second vacuum chambers together into a common vacuum space. In FIG. 13 it is assumed that instead of closing a comprehensive access door on a flat side surface, one may remove such a door altogether and attach the vacuum chambers together, their door openings facing each other, tightly enough so that a common vacuum space is formed. Another example of a mutual coupling is a thermally conductive connection between a heat radiation shield in the first vacuum chamber and a corresponding heat radiation shield in the second vacuum chamber. This way such heat radiation shields can be kept at a common temperature during operation, and the cooling power available for cooling them in the first and second vacuum chambers can be shared. Similarly, a mutual coupling may be a thermally conductive connection between a cold plate in the first vacuum chamber and a corresponding cold plate in the second vacuum chamber, with similar advantages as in the case of connected heat radiation shields.

Concerning the last-mentioned, the base temperature plates of two or more vacuum chambers of the modular cryogenic cooling system or platform may be coupled to each other. This means that there may be a common payload volume (and footprint) that can be made as large as needed, just be adding more vacuum chambers in a modular fashion. Even an existing system may be expanded later, if in the vacuum chambers of the existing system there is at least one side surface left with accessibility and one or more suitable openings.

It is also possible that the adjacent vacuum chambers are not directly against each other but facing each other at a distance. In such a case, one or more conduits between the flat side surfaces may be provided for facilitating a mutual coupling. In the schematic representation of FIG. 13, the rightmost vacuum chamber 1302 is shown displaced from the first vacuum chamber 401. Foremostly, this is a graphical representation meant to facilitate easier understanding of how mutual couplings may be enabled through the large openings in the flat side surfaces that come against each other. However, the graphical representation could also be interpreted so that one would provide a rectangular "coupling corridor" between the vacuum chambers 401 and 1302, connecting the two vacuum chambers in a gastight manner and allowing further mutual connections through such a coupling corridor.

Two or more vacuum chambers of a modularly assembled cryogenic cooling system or platform may share at least one common external support system. Examples of such external support systems include but are not limited to mechanical support, vacuum pumps, circulation systems of gases, circulation systems of cryogenic liquids, operating power, control electronics, and communication connections.

Figure 14:
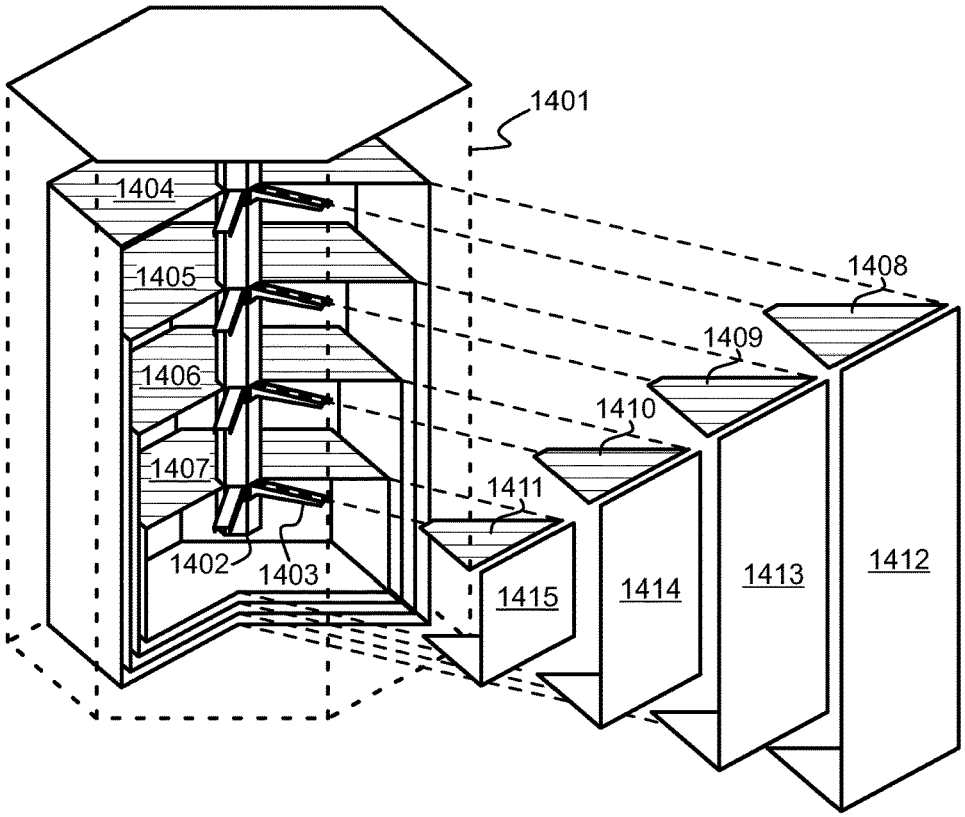
FIG. 14 illustrates a possible approach to modularity of cold plates and heat radiation shields.

FIG. 14 illustrates a cryogenic cooling system or platform that incorporates the principle of modular cold plates, however without a separate support system for the heat radiation shields. The cryogenic cooling system or platform comprises a vacuum chamber 1401 shown with dashed lines, as well as a first support system for cold plates in the vacuum chamber. The first support system is shown here to resemble those described in the other embodiments, in that it comprises a support column 1402 and a plurality of shelf supports 1403.

Coupled to the first support system of FIG. 14 and supported thereby are a plurality of mutually parallel cold plates displaced from each other in a first direction. Like the previously described embodiments, the first direction is defined as the direction perpendicular to the cold plates 1404 to 1407. In other words, the first direction is the longitudinal direction of the support column 1402. At least one of the cold plates (here: each of the cold plates) 1404 to 1407 is a modular cold plate. Similar to the previously described embodiments, a modular cold plate is one that comprises two or more sections adjacent to each other on the same level in the first direction, with said sections coupled to the first support system independently of each other.

The cold plates of the embodiment of FIG. 14 may be thought to consist of six sector-like sections. The sections closest to the viewing direction in FIG. 14 are not shown at all, for reasons of graphical clarity. The sections to the right from said missing sections are shown as temporarily removed to the front right. These are the sections 1408, 1409, 1410, and 1411 in FIG. 14.

The cryogenic cooling system or platform of FIG. 14 comprises a plurality of at least partially nested heat radiation shields. Each heat radiation shield is configured to shield a respective subspace adjacent to a corresponding one of the cold plates. As a difference to the previously described embodiments, the support system to which the heat radiation shields are coupled and that supports the heat radiation shields is the same as that supporting the cold plates.

In close resemblance to the modularity of the (at least one of the) cold plates, also at least one of the heat radiation shields (here: all heat radiation shields) is modular. In FIG. 14, radiation shield modules 1412, 1413, 1414, and 1415 are shown. Each of the radiation shield modules is sector-like, comprising a vertical, rectangular side portion and a sector-formed bottom portion. This should be construed as an example only, as the radiation shield modules could be shaped differently. For example, the side portions and bottom portions could be separate from each other, and/or there could be a set of side portions and a separate, common bottom portion of the modular radiation shield.

If the division into modules of the heat radiation shield(s) follows at least approximately the same division lines as the division into modules of the cold plate(s), an important advantage is achieved: in order to access an area inside the cryogenic cooling system or platform, it is sufficient to remove only some modules. One does not need to disassemble e.g. the whole of the plurality of heat radiation shields.

Regarding FIG. 14, we may assume that the not illustrated modules (those closest to the viewing direction) are there in place and that there is a comprehensive access door on the front right side of the vacuum chamber 1401. Opening said comprehensive access door and removing the radiation shield modules 1412 to 1415 and cold plate sections 1408 to 1411, access is acquired to a relatively large proportion of the whole inside of the vacuum chamber 1401. One could e.g. exchange some components on one or more of the cold plate sections 1408 to 1411, and/or use the access path to exchange or service something on those cold plate modules that remained in place.

Also, if two or more vacuum chambers like that in FIG. 14 are to be used as modules of a larger cryogenic cooling system or platform, one may choose not to re-install the radiation shield modules 1412 to 1415 and cold plate sections 1408 to 1411 but leave an open sector in their place, for allowing more space for couplings and connections between the sets of cold plates and/or sets of heat radiation shields of the adjacent modules.

The radiation shield modules 1412 to 1415 could be mechanically supported by the outer edges of the cold plate sections 1408 to 1411. The same would then apply to all cold plate modules and radiation shield modules in the cryogenic cooling system or platform. If such an attachment is thermally conductive, common cold sources could be used for the cold plates and their respective heat radiation shields.

Another alternative is to have the first support system support both the cold plates and the heat radiation shields, but in a way that nevertheless minimizes the thermal coupling between a heat radiation shield and its corresponding cold plate. This could be done for example so that in addition to the shelf supports 1403 for the cold plates, dedicated support arms for the heat radiation shields could extend sufficiently far outwards from the support column 1402. In such a solution, the dedicated support arms could be structurally independent enough to constitute a separate "second" support system dedicated to the heat radiation shields. Yet another alternative is to have the same shelf supports support both the cold plates and the heat radiation shields, however with as much thermal insulation as possible therebetween so that the thermal coupling between a heat radiation shield and the corresponding cold plate through the shared shelf support would be minimized.

Figure 15:
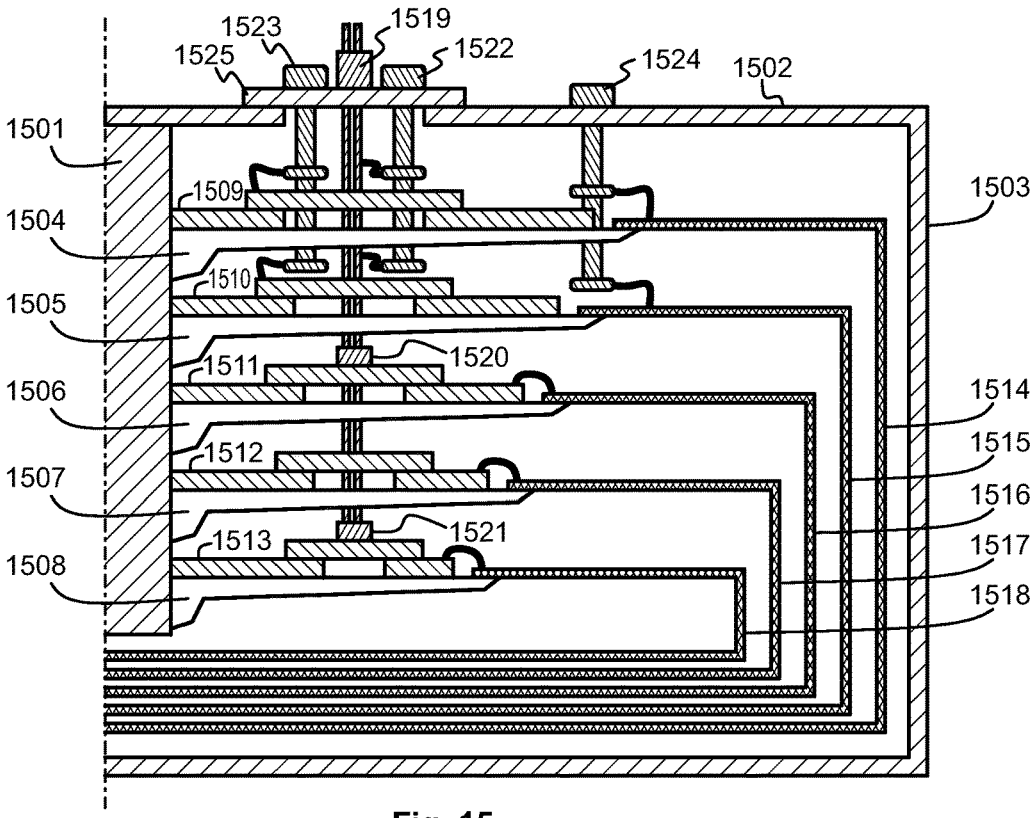
FIG. 15 illustrates schematically some parts of a cryogenic cooling system.

FIG. 15 is a partial cross section of one half of a cryogenic cooling system or platform. The cross section is limited by a support column 1501 on the left, as well as a top 1502 and body 1503 of a vacuum chamber. A first support system comprises the support column 1501 and a plurality of shelf supports 1504, 1505, 1506, 1507, and 1508. Coupled to the first support system and supported thereby is a plurality of mutually parallel cold plates 1509, 1510, 1511, 1512, and 1513 displaced from each other in the direction of the support column 1501, which is the direction perpendicular to the cold plates.

Coupled to the same, first support system and supported thereby is a plurality of a least partially nested heat radiation shields 1514, 1515, 1516, 1517, and 1518. Each of the heat radiation shields is configured to shield a respective subspace adjacent to a corresponding one of said cold plates 1509 to 1513.

FIG. 15 emphasizes an aspect, according to which it is not essential, whether the cold plates and/or heat radiation shields exhibit any modularity, because certain important advantages can be gained through clever use of dedicated cold sources. Adding modularity to the principles shown in FIG. 15 brings about additional advantages, as has been described elsewhere in this text, but the use of cold sources as in FIG. 15 also has advantages of its own.

There are a total of four cold sources shown in FIG. 15. One of them is a dilution refrigerator 1519, which has its still 1520 located on and coupled to the middle cold plate 1511 and its mixing chamber 1521 located on and coupled to the bottom cold plate 1513. Another dedicated cold source is a first mechanical cooler 1522, which is dedicated to precooling the dilution refrigerator 1519 through thermal coupling to its upper parts, roughly in the cold domains of the top and second cold plates 1509 and 1510 respectively. Another dedicated cold source is a second mechanical cooler 1523, which has its higher and lower stages thermally coupled to the top and second cold plates 1509 and 1510 respectively. A yet further cold source is a third mechanical cooler 1524, which has its higher and lower stages thermally coupled to the first and second heat radiation shields 1514 and 1515 respectively.

Additional cold sources could be provided, and/or heat switches could be installed between selected parts of the system, like between selected cold plates, in order to have sufficient cooling at all parts. Such possible additional cold sources and heat switches are not shown in FIG. 15 for graphical clarity.

The principle shown in FIG. 15 can be generally described as follows. The cryogenic cooling system or platform has one or more dedicated cold sources configured to cool at least some of the heat radiation shields without cooling any of the cold plates, and a second dedicated cold source configured to cool at least some of the cold plates without cooling any of said heat radiation shields. This principle is thus applicable irrespective of whether the cold plates and/or heat radiation shields exhibit modularity, and irrespective of whether the cold plates and/or heat radiation shields share a common support system or whether they have separate support systems.

In FIG. 15, there is a thermal coupling from the three lowest cold plates 1511, 1512, and 1513 to the respective heat radiation shields 1516, 1517, and 1518. Thus, the dilution refrigerator cools not only the three lowest cold plates 1511, 1512, and 1513 to the respective heat radiation shields 1516, 1517, and 1518. However, as there is a dedicated cold source (third mechanical cooler 1524) for the two outermost heat radiation shields, effective cooling of all said parts can be achieved. If needed, a modular lowest cold plate 1513 could be used with yet another dilution refrigerator to cool those parts of payload that require the very lowest temperatures.

Yet another aspect illustrated in FIG. 15, which aspect can be applied in all other embodiments described herein as well, is the provision of at least some of the cold sources in separately removable inserts. The room-temperature parts of the dilution refrigerator 1519, as well as those of the first and second mechanical coolers 1522 and 1523, are placed on a removable part 1525 of the top 1502. Also the cold stages of said cold sources are attached to removable portions of the respective cold plates. Taken that the dimensioning of such removable portions and the respective apertures is selected right, it may be possible to lift the whole entity consisting of the cold sources and said removable parts out of the cryogenic cooling system or platform for servicing. Additionally, this principle may allow exchanging the whole insert with another insert that may have cold sources of different cooling power, or even cold sources of different technology built in it.

Variations and modifications to the embodiments described above are possible. For example, while the embodiments described so far all have a top of the vacuum chamber as a unitary piece, this is not a requirement. In conventional cryostats it was common to have the main vacuum can hang from a top flange or lid, which was a unitary and mechanically very strong piece because it had to carry the whole weight of the vacuum can and everything inside it. An external support frame was provided, to which the top flange of the vacuum chamber was attached.

In contrast to such prior art systems, a cryogenic cooling system or platform of the kind described in this text may be simply standing on a flat surface, supported by the lower parts of the vacuum chamber, in which case the mechanical loads to its top parts may be relatively small compared to conventional structural solutions. This can be utilised by making also the top of the vacuum chamber modular, so that it has a support frame with one or more openings, with removable lids covering said openings in a gastight manner. This would allow having physical access to the inside of the vacuum chamber also from above. Another advantage of having a modular top of the vacuum chamber is the reduced weight and size of components that need to be transported and assembled.

The first and second support systems have been described as if they were two completely different systems. This is not an obligatory requirement, as some structural parts may have a role in supporting both cold plates and heat radiation shields. The separate naming of first and second support systems is more conceptual by nature and emphasizes the fact that the cryogenic cooling system or platform may have separate cold sources for cold plates and heat radiation shields, when these two are not necessarily in intimate thermally conductive connection with each other. An example of a possible "hybrid" support system is one where the outermost heat radiation shield is directly supported by the topmost cold plate, and a separate second support system then begins at the outermost heat radiation shield and serves to support the further, inner heat radiation shields.

The cold plates have been shown having relatively simple and compact shapes. This is only for reasons of graphical clarity. A real-life cold plate (or a section thereof) may have a relatively complicated outline, with slots, finger-like extensions, openings, and the like. One advantage that can be gained through such more complicated shapes of the cold plates or their sections is the increased surface area, which can be used for example to attach payload.

In the foregoing, embodiments of the invention have been mainly described in an upright configuration, with the so-called first direction vertical and with the coldest plate at the bottom of the stack of mutually displaced cold plates. This is merely a graphical convention and selected for easy comparison to prior art. As such, the cryogenic cooling system or platform described in this text does not need to be oriented in any particular way. For example, the first direction may be other than vertical. As another example, even if the first direction was vertical the order of the cold plates may be inverted so that the base temperature plate is at the top.

It is obvious to a person skilled in the art that with the advancement of technology, the basic idea of the invention may be implemented in various ways. The invention and its embodiments are thus not limited to the examples described above, instead they may vary within the scope of the claims.

The invention claimed is:

1. A cryogenic cooling system, comprising:

a vacuum chamber, a first support system for cold plates in said vacuum chamber, a second support system for heat radiation shields in said vacuum chamber, coupled to said first support system and supported by the first support system, said cold plates comprise a plurality of cold plates being mutually parallel and displaced from each other in a first direction, said first direction being defined as the direction perpendicular to a surface of said plurality of cold plates, coupled to said second support system and supported by the second support system, said heat radiation shields comprise a plurality of heat radiation shields at least partially nested, each of said heat radiation shields being configured to shield a respective subspace adjacent to a corresponding one of said cold plates;

wherein:

at least a first cold plate of said cold plates is a modular cold plate comprising two or more sections adjacent to each other on a same level in said first direction, wherein mutually adjacent edges of said sections of the modular cold plate do not touch each other, and said sections being coupled to said first support system independently of each other.

2. The cryogenic cooling system according to claim 1, wherein:

said plurality of cold plates comprises an ordered sequence of cold plates configured to be held at temperatures that form a respective monotonically decreasing series from a highest temperature to a lowest temperature, and at least one cold plate higher up in said ordered sequence of cold plates is removable from said first support system without removing any of the cold plates below it in said ordered sequence of cold plates.

3. The cryogenic cooling system according to claim 1, wherein a coupling member couples said mutually adjacent edges of said sections to each other.

4. The cryogenic cooling system according to claim 1, wherein one of said heat radiation shields that shields a subspace adjacent to said modular cold plate is thermally insulated from at least one of said sections.

5. The cryogenic cooling system according to claim 1, comprising a first dedicated cold source configured to cool at least some of said plurality of heat radiation shields without cooling any of said plurality of cold plates, and a second dedicated cold source configured to cool at least some of said plurality of cold plates without cooling any of said plurality of heat radiation shields.

6. The cryogenic cooling system according to claim 1, wherein:

the cryogenic cooling system comprises a first dilution refrigerator and a second dilution refrigerator, said first dilution refrigerator is configured to cool a first subsection of a target region located on one of said plurality of cold plates, and said second dilution refrigerator is configured to cool a second subsection, thermally insulated from said first subsection, of said target region.

7. The cryogenic cooling system according to claim 1, wherein the vacuum chamber has a top, a bottom, and a plurality of connected side surfaces between said top and bottom, at least one of said plurality of connected side surfaces being a flat surface.

8. The cryogenic cooling system according to claim 1, wherein:

said vacuum chamber is a first vacuum chamber, constituting a first vacuum module in which said first support system and said second support system are located, said plurality of cold plates is a first plurality of cold plates, located in said first vacuum chamber and supported by said first support system, said plurality of heat radiation shields is a first plurality of heat radiation shields, located in said first vacuum chamber and supported by said second support system, the cryogenic cooling system comprises a second vacuum chamber, a third support system for a second plurality of cold plates in said second vacuum chamber, and a fourth support system for a second plurality of heat radiation shields in said second vacuum chamber, the cryogenic cooling system comprises, coupled to said third support system and supported by said third support system, said second plurality of cold plates being mutually parallel and displaced from each other in said first direction, the cryogenic cooling system comprises, coupled to said fourth support system and supported by said fourth support system, said second plurality of heat radiation shields at least partially nested, each of said heat radiation shields being configured to shield a respective subspace adjacent to a corresponding one of said second plurality of cold plates the cryogenic cooling system comprises at least one mutual coupling that is at least one of: an opening connecting said first vacuum chamber and said second vacuum chambers together into a common vacuum space; a thermally conductive connection between a heat radiation shield of the first plurality of heat radiation shields and a heat radiation shield of the second plurality of heat radiation shields; and a thermally conductive connection between a cold plate of the first plurality of cold plates and a cold plate of the second plurality of cold plates.

9. The cryogenic cooling system according to claim 3, wherein said coupling member comprises at least one of:

a stainless steel strip, a thermal coupling block, or a shelf support that is part of said first support system and supports said sections by their adjacent edges.

10. The cryogenic cooling system according to claim 6, wherein:

said first subsection of the target region comprises a thermalization stage of connections between the target region and parts warmer than the target region of the cryogenic cooling system, and said second subsection of the target region comprises a payload area.

11. The cryogenic cooling system according to claim 7, wherein the vacuum chamber has a constant polygonal cross section in a plane perpendicular to said first direction.

12. The cryogenic cooling system according to claim 11, wherein at least a subset of said plurality of heat radiation shields have a cross section that is the same shape as a cross section of said vacuum chamber.

13. The cryogenic cooling system according to claim 12, wherein at least one of said subset of the heat radiation shields comprises sheet portions releasably coupled to the second support system and to each other.

14. The cryogenic cooling system according to claim 8, wherein:

each of the first vacuum chamber and second vacuum chambers has a top, a bottom, and a plurality of connected side surfaces between said top and bottom, at least one side surface in each of the first vacuum chamber and second vacuum chambers being a flat surface, the first vacuum chamber and second vacuum chambers are adjacent to each other, with said flat side surfaces against each other, and said mutual coupling goes through an interface of which said flat side surfaces are a part.

15. The cryogenic cooling system according to claim 8, wherein said first vacuum chamber and second vacuum chambers share at least one common external support system, which comprises at least one of: mechanical support, vacuum pumps, circulation system of gases, circulation system of cryogenic liquids, operating power, control electronics, communication connections.

16. The cryogenic cooling system according to claim 14, wherein:

the first vacuum chamber and second vacuum chambers have said flat side surfaces directly connected to each other, and openings in said flat side surfaces convey said mutual coupling.

17. The cryogenic cooling system according to claim 14, wherein:

the first vacuum chamber and second vacuum chambers are located with said flat side surfaces facing each other at a distance, and one or more conduits between said flat side surfaces convey said mutual coupling.

18. A cryogenic cooling system, comprising:

a first vacuum chamber, constituting a first vacuum module, a first support system for cold plates in said first vacuum chamber, coupled to said first support system and supported by the first support system, said cold plates comprising a first plurality of mutually parallel cold plates displaced from each other in a first direction, said first direction being defined as the direction perpendicular to a surface of said first plurality of mutually parallel cold plates, wherein a first cold plate of said first plurality of mutually parallel cold plates is a modular cold plate comprising two or more sections adjacent to each other on a same level in said first direction, wherein mutually adjacent edges of said sections of the modular cold plate do not touch each other, a second vacuum chamber, constituting a second vacuum module, a second support system for second cold plates in said second vacuum chamber, coupled to said second support system and supported by the second support system, said second cold plates comprising a second plurality of mutually parallel cold plates displaced from each other in said first direction, and at least one mutual coupling that is at least one of: an opening connecting said first and second vacuum modules together to form a common vacuum space; a thermally conductive connection between a cold plate of the first plurality of cold plates and a cold plate of the second plurality of cold plates.

* * * * *